US006367566B1

(12) United States Patent
Hill

(10) Patent No.: US 6,367,566 B1
(45) Date of Patent: Apr. 9, 2002

(54) DOWN HOLE, HYDRODYNAMIC WELL CONTROL, BLOWOUT PREVENTION

(76) Inventor: Gilman A. Hill, 7128 S. Poplar La., Englewood, CO (US) 80112

( * ) Notice: Subject to any disclaimer, the term of this patent is extended or adjusted under 35 U.S.C. 154(b) by 0 days.

(21) Appl. No.: 09/253,200

(22) Filed: Feb. 19, 1999

Related U.S. Application Data

(60) Provisional application No. 60/075,379, filed on Feb. 20, 1998.

(51) Int. Cl.[7] ..... E21B 7/00

(52) U.S. Cl. ..... 175/57; 166/370; 175/215; 175/324

(58) Field of Search ..... 175/57, 324, 215; 166/370, 242.1

(56) References Cited

U.S. PATENT DOCUMENTS

| | | | | |
|---|---|---|---|---|
| 2,693,854 A | | 11/1954 | Abendroth | |
| 2,838,117 A | | 6/1958 | Clark et al. | |
| 2,848,052 A | | 8/1958 | Stinson | |
| 2,851,109 A | | 9/1958 | Spearow | |
| 2,935,129 A | | 5/1960 | Allen et al. | |
| 3,032,104 A | | 5/1962 | O'Reilly | |
| 3,139,139 A | | 6/1964 | Elkins | |
| 3,280,912 A | | 10/1966 | Sheffield, Jr. | |
| 3,419,092 A | * | 12/1968 | Elenburg | 175/69 |
| 3,428,129 A | | 2/1969 | Cook | |
| 3,730,276 A | | 5/1973 | Land | 166/314 |
| 3,825,071 A | | 7/1974 | Veatch, Jr. | 166/308 |
| 3,878,884 A | | 4/1975 | Raleigh | 165/1 |
| 3,933,205 A | * | 1/1976 | Kiel | 166/308 |
| 3,965,982 A | | 6/1976 | Medlin | 166/249 |
| 4,068,718 A | | 1/1978 | Cooke, Jr. et al. | 166/280 |
| 4,078,609 A | | 3/1978 | Pavlich | 166/271 |
| 4,100,981 A | * | 7/1978 | Chaffin | 175/60 |
| 4,109,721 A | | 8/1978 | Slusser | 166/280 |
| 4,186,802 A | | 2/1980 | Perlman | 166/280 |

(List continued on next page.)

*Primary Examiner*—Hoang Dang
(74) *Attorney, Agent, or Firm*—Sheridan Ross PC

(57) ABSTRACT

The system and method of the present invention permits control of down hole fluid pressures during under balanced drilling, tripping of the drill string, and well completion to substantially avoid "killing" of the well and thereby damaging the producing formations in the well bore. The system and method utilizes separate and interconnected fluid pathways for introducing a downwardly flowing hydrodynamic control fluid through one fluid pathway and for removing through the other fluid pathway a commingled fluid formed by mixing of the hydrodynamic control fluid and the well bore fluids flowing upwardly in the well bore.

21 Claims, 13 Drawing Sheets

U.S. PATENT DOCUMENTS

| | | | | | |
|---|---|---|---|---|---|
| 4,391,337 | A | | 7/1983 | Ford et al. | 175/4.6 |
| 4,456,069 | A | | 6/1984 | Vigneri | 166/303 |
| 4,534,426 | A | * | 8/1985 | Hooper | 175/65 |
| 4,630,691 | A | * | 12/1986 | Hooper | 175/65 |
| 4,633,951 | A | | 1/1987 | Hill et al. | 166/308 |
| 4,640,355 | A | | 2/1987 | Hong et al. | 166/269 |
| 4,678,037 | A | * | 7/1987 | Smith | 166/299 |
| 4,683,943 | A | * | 8/1987 | Hill et al. | 166/63 |
| 4,687,061 | A | * | 8/1987 | Uhri | 166/308 |
| 4,714,115 | A | * | 12/1987 | Uhri | 166/308 |
| 4,718,493 | A | * | 1/1988 | Hill et al. | 166/308 |
| 4,823,875 | A | * | 4/1989 | Hill | 166/280 |
| 4,852,650 | A | * | 8/1989 | Jennings et al. | 166/250 |
| 4,869,322 | A | * | 9/1989 | Vogt, Jr. et al. | 166/280 |
| 4,887,670 | A | * | 12/1989 | Lord et al. | 166/281 |
| 4,893,676 | A | * | 1/1990 | Hill | 166/280 |
| 4,917,188 | A | * | 4/1990 | Fitzpatrick, Jr. | 166/295 |
| 4,938,286 | A | * | 7/1990 | Jennings, Jr. | 166/280 |
| 5,018,578 | A | | 5/1991 | El Rabaa et al. | 166/281 |
| 5,036,918 | A | * | 8/1991 | Jennings, Jr. et al. | 166/263 |
| 5,036,919 | A | | 8/1991 | Thomas et al. | 166/271 |
| 5,056,598 | A | * | 10/1991 | Jennings, Jr. | 166/308 |
| 5,101,913 | A | * | 4/1992 | Stockley et al. | 175/65 |
| 5,159,979 | A | * | 11/1992 | Jennings, Jr. | 166/280 |
| 5,161,618 | A | * | 11/1992 | Jones et al. | 166/308 |
| 5,273,115 | A | * | 12/1993 | Spafford | 166/281 |
| 5,295,545 | A | * | 3/1994 | Passamaneck | 166/299 |
| 5,314,020 | A | * | 5/1994 | Jennings, Jr. et al. | 166/281 |
| 5,355,802 | A | * | 10/1994 | Petitjean | 102/313 |
| 5,358,047 | A | | 10/1994 | Himes et al. | 166/280 |
| 5,417,287 | A | | 5/1995 | Smith et al. | 166/308 |
| 5,441,110 | A | | 8/1995 | Scott, III | 166/308 |
| 5,865,261 | A | * | 2/1999 | Cooper et al. | 175/71 |
| 5,873,420 | A | * | 2/1999 | Gearhart | 175/25 |
| 5,875,843 | A | | 3/1999 | Hill | 166/250 |

* cited by examiner

Formation And Well-Bore Pressure

Well-Bore Pressures in a "Dry Gas " Producing Well During Work-Over Operations

Well-Bore Pressures in a "Wet Gas " Producing Well During Work-Over Operations

Well-Bore Pressures In a "Wet Gas" Producing Well With Water With Water In-Flow at 5,000' to 7,000' Depth In A Producing Well Well-Bore Pressures During Snubbing Operations On A Drilling Well Well-Bore Pressures During Snubbing Operations In A Completion Operation Well-Bore Pressures In A "Wet Gas" Producing Well During Shut-In Of Well Example 2: Well-Bore-Drilling Pressure Profiles Example 2: Well-Bore, Pipe-Tripping Pressure Profiles Example 2: Well-Bore, Pipe-Tripping Pressure Profiles With Gel-Plug Barrier

DOWN HOLE, HYDRODYNAMIC WELL CONTROL, BLOWOUT PREVENTION

CROSS REFERENCE TO RELATED APPLICATION

This application claims the benefits under 35 U.S.C. § 119(e) of Provisional Application No. 60/075,379, filed Feb. 20, 1998, to Hill is incorporated herein by reference.

FIELD OF THE INVENTION

The present invention relates generally to a method and apparatus of hydrodynamically controlling well-bore fluids down in oil and/or gas wells to prevent uncontrolled well blowouts while maintaining any desired degree of fluid dynamics underbalanced, neutral balanced, or overbalanced conditions for drilling, completion, or work-over operations in such wells.

BACKGROUND OF THE INVENTION

Well bore drilling is commonly performed by one of two techniques, namely overbalanced drilling and under balanced drilling. Overbalanced drilling refers to a well drilling process in which the drilling mud is maintained at a pressure greater than the formation pressure to inhibit the flow of fluids in the formation into the well bore. Under balanced drilling, in contrast, refers to a well drilling process in which the drilling mud is maintained at a pressure less than the formation pressure, thereby permitting formation fluids to flow into the well bore. Under balanced drilling techniques are gaining wider acceptance in the drilling industry because of the significantly lower likelihood of damage to the formation during drilling compared to overbalanced drilling techniques. When the drilling fluid has a greater pressure than the formation pressure, the formation can be damaged by penetration of drilling fluids into the formation or into formation fractures.

During the drilling, completion, and work-over operations in oil and gas wells, down-hole formation fluids entering the well bore may cause the well-bore fluids to be blown out of the well bore, which may result in an uncontrolled and hazardous well blowout or in very difficult operating conditions for the later work in the well bore. To prevent such uncontrolled blowouts, the operator/owner of the well typically circulates into position in the well bore a heavy enough fluid (i.e., drilling mud) to create a well-bore fluid pressure sufficient to exceed the current pressure of the formation fluid adjacent to the well bore, thereby preventing (i.e., killing) the flow of such formation fluid into the well bore. This process of circulating or injecting a fluid into the well bore of sufficient weight to prevent formation fluid from entering the well bore is commonly called "killing the well", which results in well-bore fluid at the surface well head having no significant pressure.

This common practice of killing the well preparatory to tripping drill pipe or production equipment in or out of the well bore often results in serious damage to the formation around the well bore or adjacent to any fractures connected to the well bore. When the well is killed for any purpose, the wellbore fluid at higher pressure than the adjacent formation fluid will flow into the adjacent formation, resulting in reduction of the rock permeability to the production of formation fluids. In many formations, this reduction of permeability to formation fluids in the zones invaded by well-bore fluids may result in permanent or long-term damage to the well productivity. This damage is especially serious if a producing well, completed by hydraulic fracture stimulation, is killed because the killing well-bore fluid then may invade and damage the formation adjacent to the entire length and height of the hydraulic fracture.

As an alternative to killing the well with a heavy well-bore fluid, the drill pipe, production tubing or other equipment may be stripped in or out of the well under high well-head pressure through a snubbing unit. This procedure is expensive and complicated. Furthermore, if the well is shut-in under high pressure while stripping pipe or equipment in or out of the well through a snubbing unit, the liquids at the bottom of the well bore may be injected into the formation adjacent to the well bore and adjacent to the hydraulic fractures. In the zones invaded by these bottom-hole well-bore liquids while stripping through the snubbing unit, the rock permeability to the formation fluids may be severely damaged as described above.

In order to prevent damage to the producing reservoir formations, it is desirable not to kill the well by injection of well-bore fluids and not to shut-in the well with any liquids in the well bore as previously commonly done for the purpose of tripping drill pipe, production tubing or other equipment in or out of the well bore. To prevent reservoir damage from the invasion of well-bore liquids into the formation adjacent to the well bore or adjacent to the hydraulic fractures, it is desirable to maintain the down-hole well-bore fluid pressure at a level less than the then current pressure of the formation fluids in the adjacent reservoir rock. These fluids should flow only from the formation into the well bore or fracture and never from the well bore or fracture into the formation.

SUMMARY OF THE INVENTION

An objective of this invention is to provide a system for maintaining or regaining effective control of the well-bore fluids by circulating down hole a hydrodynamic control fluid through a dual path circulation system to prevent well-bore blow-outs under any drilling condition of underbalanced drilling, neutral balanced drilling, or overbalanced drilling, whether drilling ahead or while tripping the drill pipe out of the hole.

Another objective of this invention is to provide a system for maintaining a low or near-zero surface fluid pressure on the annulus fluid surrounding the drill pipe at the well head to permit the drill pipe to be rotated or moved up or down in the well bore while drilling ahead or tripping in or out of the hole without needing any high-pressure well-head rotating seal or pipe stripping seal and while maintaining any desired bottom-hole, well-bore pressure and any desired formation fluid flow dynamic condition in the lower portion of the well-bore.

An objective of this invention is to provide a system for under balanced drilling a well while substantially continuously maintaining the production (i.e., flow) of formation fluids into the well bore throughout all phases of the drilling operation, including tripping the drill string in and out of the well bore, while avoiding stripping the drill string in or out of the well head under significant or difficult high well-head pressures. During all phases of the drilling operation, the down-hole well-bore fluid pressure is not allowed to significantly exceed the formation fluid pressure adjacent to the well bore and, thereby, is not allowed to kill (i.e., stop) the continuous flow of formation fluids into the well bore and is not allowed to inject any non-formation fluids into the formations adjacent to the well bore.

Another objective of this invention is to provide a system for performing well work over, maintenance, completion, and recompletion operations in a producing oil and/or gas well, including the tripping of tubing and tools in and out of the well bore, without killing the well or stopping the continuous production of formation fluids into the well bore and without having to strip the tubing and tools in or out of the well head under significant or difficult well-head pressures. During all phases of these operations, the well-bore fluid pressure maintained at a level that does not significantly exceed the formation fluid pressure adjacent to the well bore and, thereby, is not allowed to kill (i.e., stop) the continuous flow of formation fluids into the well bore and is not allowed to inject any non-formation fluids into the formations adjacent to the well bore or adjacent to the hydraulic fractures extending from the well bore.

Another objective of this invention is to provide a system for performing any of the prior stated objectives without using a snubbing unit or other such surface pressure containment equipment to trip pipe and equipment in and out of the well bore.

Another objective of this invention is to provide a system for performing any of the prior stated objectives while being able to trip pipe and equipment in or out of the well bore without any produced formation fluids flowing out through the open well head through which such pipe and equipment is moving.

These objectives are realized by the methodology and system of the present invention. The method broadly includes the steps of: (a) introducing a hydrodynamic control fluid into a first flow pathway extending along an upper portion of the well bore which contains the drill shing; (b) commingling the downward flowing hydrodynamic control fluid with a well-bore fluid flowing upwardly from a lower portion of the well bore to form a commingled fluid; and (c) directing the flow of at least most of the commingled fluid along a second flow pathway that is different from the first flow pathway and extends along an upper portion of the well bore to maintain a fluid pressure in a selected portion of the well bore at or below a predetermined fluid pressure level near the bottom of the hole level. Commonly, the predetermined is less than the formation pressure. The fluid flow pathways preferably intersect to permit the hydrodynamic control fluid to commingle with the well bore fluid and the commingled fluid to enter the second flow pathway. The various flow pathways are defined by the positioning of one or more casings in the well bore.

By way of illustration, in one casing configuration the produced formation fluids, commingled with other well-bore fluids, flowing up the well bore from below are diverted into a controlled flow discharge path (or second flow pathway) located in an outer annulus defined by an inner casing and an outer casing. The hydrodynamic control fluid flows downwardly inside of the inner casing (the first flow pathway). The inner casing is hereinafter referred to as the inner hydrodynamic control casing. The hydrodynamic downward flow of a liquid preferably has a downward velocity greater than the upward migration velocity of gas and/or oil bubbles and/or gas and/or oil slugs attempting to rise through the hydrodynamic control fluid (which is preferably a liquid or gelled liquid) by buoyancy. This hydrodynamic control fluid flows downwardly inside the inner hydrodynamic control casing and then flows around the bottom of the inner casing and/or through perforations in the inner hydrodynamic control casing and into the outer annulus. In the outer annulus the hydrodynamic control fluid commingles with the mixture of upwardly flowing well-bore fluids from below as they are diverted from a third annulus located below the fluid interconnection between the annulus inside the inner casing and the annulus between the inner and outer castings.

The commingled fluid s flow upwardly in the outer annulus to the casing head and then out through discharge ports, valved manifolds, and flow lines to a discharge and burn pit. The commingled fluids flow into the discharge/burn pit at atmospheric pressure. The pressure gradient along the discharge flow path up the outer annulus is dependent upon the average density of the coming led fluids and its dynamic friction loss along the outer annulus.

However, if the commingled discharge fluids contain significant amounts of expanding formation gas, the pressure gradient can be very low. In that event, with the discharge to the burn pit being at atmospheric pressure and the average pressure gradient of the commingled discharge fluids in the outer annulus being very low, the down-hole pressure at the bottom of and/or perforations in the inner casing will be substantially less than the hydrostatic head of water from the surface to the depth of the bottom and/or perforations in the inner casing. Consequently, if water drilling mud or other liquid is pumped down the inner casing to create the hydrodynamic down flow needed to divert the up-flowing formation/well-bore fluids from below out into the outer annulus, then the dynamic water drilling water or other liquid level in the inner casing may be several hundred feet below the well head at the ground surface. In this case, the pipe and equipment can be tripped in or out of th e well bore dry with n o formation fluid (i.e., gas or oil) appearing inside the open inner casing at the surface.

However, large volumes of formation fluids (i.e. including gas and/or oil) may nonetheless be diverted hydrodynamically at the bottom of or perforations in the inner casing and, thereby, be caused to flow up the annulus between the two casings and be discharged at controlled low pressures into the burn pit (or separator tanks). This pressure controlled discharge of produced formation fluids up through the annulus between the inner and outer casings and out through a valved manifold to a burn pit (or separator tanks) provides the means to maintain controlled, low, bottom-hole pressure to assure continuous production of formation fluids into the well bore and to prevent the injection of any non-formation fluid from the well bore into the formation (or fractures) during any tripping of pipe or equipment or any work or operations being done in the well bore.

An optional piece of equipment that may be added at the bottom of the inner casing to inhibit the entry of well-bore fluids into the inner casing and to substantially reduce the volume rate of injecting the hydrodynamic control fluid down the inner casing is a leaky hydrodynamic partial barrier. This piece of equipment, also called a hydrodynamic barrier, may be (a) a rubber seal similar to a drilling rotating head, (b) a semi-circular, cross-sectional donut ring of flexible, deformable rubber, whose inside diameter can be elastically stretched to loosely fit over the diameter each of the tools or pipe which need to pass through this barrier, (c) an inverse, flexibly deformable, belly-spring centralizer bag squeezing inward from the inner casing wall, (d) a surface controlled, hydraulically actuated, down-hole, shut-off valve or partial shut-off restriction and/or such shut-off valve with a limited volume, fluid by-pass opening, or (e) many alternative designs as may be created by oil/gas tool design engineers who are skilled in the art of designing, manufacture, and operation of similar down hole, well-bore tools.

This hydrodynamic barrier is designed not to make a pressure seal against the centralized pipe or tools but rather to provide a reduced cross-sectional area flow path for the downward flowing hydrodynamic fluids. This reduced cross-sectional area flow path creates a proportionally increased flow velocity of the hydrodynamic fluid flowing past this barrier. Consequently, the velocity of the downward flow past this reduced area hydrodynamic barrier can be sufficient to exceed the velocity of gas bubbles or slugs of gas trying to migrate upward by buoyancy in the hydrodynamic control fluid even when the volumetric rate of injecting the hydrodynamic control fluid into the inner casing is very low. The horizontal cross-sectional area of the leakage path adjacent to the hydrodynamic barrier preferably ranges from about 2% to 20% of the horizontal cross-sectional area of the inner annulus. Also, the hydrodynamic control fluid above this hydrodynamic barrier may be gelled to increase its viscosity, and decrease the buoyancy upward velocity of gas bubbles or gas slugs in the hydrodynamic control fluid and thereby further decrease the volumetric flow rate of the control fluid needed to achieve the hydrodynamic diversion control objective.

The pressure difference across this hydrodynamic barrier should be very small. In many well-bore applications, this optional hydrodynamic barrier is not needed and will not be used. The hydrodynamic control fluid viscosity, gel strength, density, and height will provide adequate means to control the diversion of the commingled fluid out into the outer annulus. The pressure at the bottom of the column of hydrodynamic control fluid inside the inner casing may be only a few psi greater than the fluid pressure below the barrier the pressure of the column of produced formation fluids commingled with the other well-bore fluids flowing up the annulus between the inner and outer casings and vented to the burn pit. If the fluid column diverted to flow up the outer annulus contains a significant volume of expanding gas that decreases the density of the fluid column and if the fluid column is vented to the atmosphere in the burn pit, then the low fluid pressure at the bottom of this outer annulus where these fluids are commingled will be balanced by the pressure of the column of the properly designed hydrodynamic control dynamic fluid, with a height shorter than the distance to the surface well head. Therefore, the hydrodynamic control fluid can be pumped into the inner casing at atmospheric pressure, and it will fall down the inner casing to the fluid level and thereby balance the pressure of the column of low-density, commingled produced fluids (including expanding gas) flowing up the outer annulus and out to the bum pit. Consequently, the pipe and tools needed for drilling, completing, or work over can be tripped through the well head and into or out of the well bore with substantially zero fluid pressure at the surface and no produced fluids coming to the surface inside the inner casing to hinder the crew working on the derrick floor. The purpose of the increased viscosity of the gelled water hydrodynamic control fluid, is to reduce the volume rate of injecting the hydrodynamic control fluid into the inner casing needed to prevent the produced fluids (i.e., oil and/or gas) from migrating by buoyancy up through the hydrodynamic control fluid.

Accordingly, the system and method of the present invention acts as and is therefore hereinafter referred to as the down-hole "hydrodynamic blowout-preventer", or "H-BOP".

DETAILED DESCRIPTION

Figures 1A, 1B:
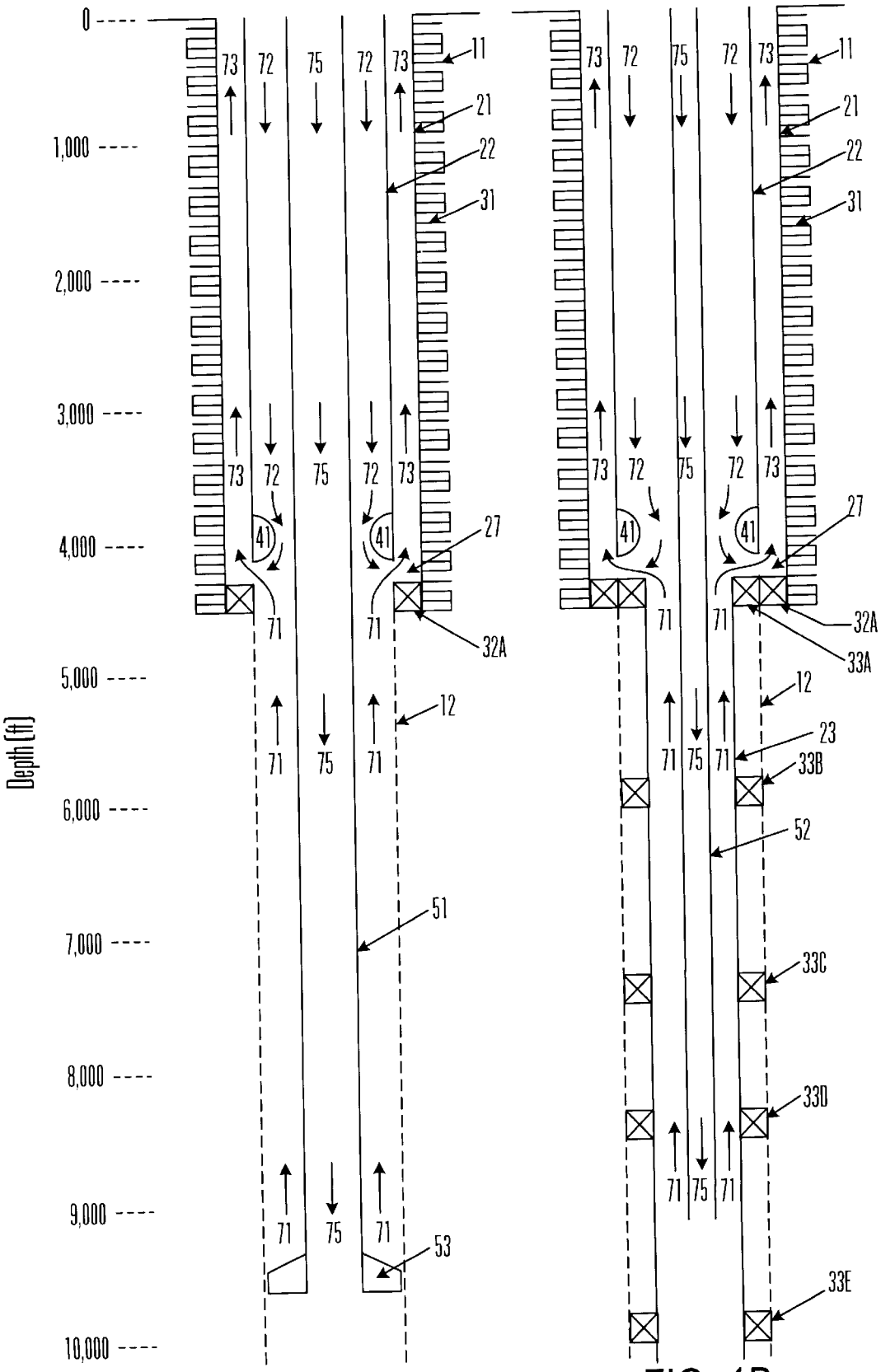
FIG. 1A depicts a typical well according to the present invention during the drilling operation and FIG. 1-B depicts the well after setting the production casing for well completion.

FIG. 1-A shows the drilling of a typical well bore using the methodology of the present invention. A surface hole is drilled to a selected depth using conventional drilling techniques where an outer casing 21 is set from surface to bottom of this surface drilled hole 11. Cement 31 is circulated into the annulus between the surface hole 11 and the outer casing 21.

The inner casing 22 with a series of large, open, side ports 27, is set concentrically inside the outer casing 21 to provide an open-annulus path 73 between the two casings. The bottom of the inner casing 22 is sealed against the outer casing 21 by either a short column of cement 32A or a pack-off system such as an external casing packer 32A mounted on the inner casing 22. The top of casing 22 is sealed against the outer casing 21 in the casing head (not shown in FIG. 1) at the surface of the ground with an exit from this casing head through an exit port, a valved manifold, and through discharge pipes to discharge burn pit. In this configuration, fluids can be circulated 72 down the inside of the inner casing 22, through the open ports 27, up the annulus between the inner and outer casings, and then out through the casing-head exit port, the valved manifold and the discharge pipes to the burn pit.

The well is next deepened by drilling the hole 12 to the desired well total depth. The deeper section of the well 12 is drilled with under balanced drilling fluid as later described by reference to FIGS. 3 and 4, then the formation fluids will flow into the open-hole well bore 12. If the formation fluids are low density crude oil and/or expandable gases, the resulting decreased pressure gradient and increased flow rate up the drilling annulus 71 between the drill-hole wall 12 and the drill pipe 51 may be very difficult to handle at the surface if the well-control circulation paths 72 and 73 are not present. The well-control fluids of this invention are circulated down the inner-annulus 72 between the inner casing and the drill pipe 51 and thereby divert the upward flowing commingled drilling mud and produced formation fluids 71 out through the open ports 27 and then up through the outer-annulus flow path 73. The commingled fluids are then discharged out through the above surface stationary, non-rotating casing head, ports, then through the valved manifold, and discharge pipes to the burn pit. The requirement to achieve substantially complete diversion of the upward flowing commingled mud and formation fluids 71 out through the open ports 27 in the inner casing 22 into annulus 73 is that the hydrodynamic well control fluid 72 downward flow velocity must exceed the upward velocity of any produced fluid 71 bubbles or slugs attempting to migrate, by buoyancy forces, upwardly through the downward flowing well control fluid 72.

Figure 2A:
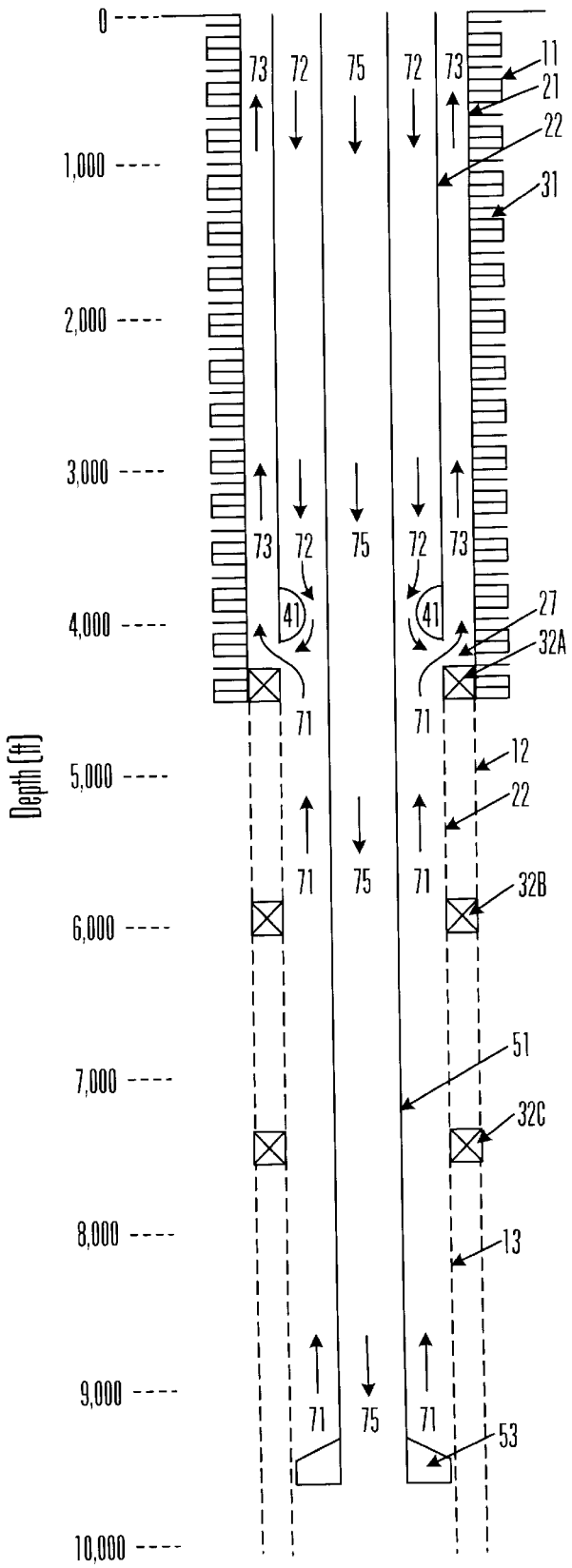
FIG. 2A depicts a well according to a second embodiment of the present invention during the drilling operation and FIG. 2-B depicts the well after setting the production liner for well completion.
Figure 2B:
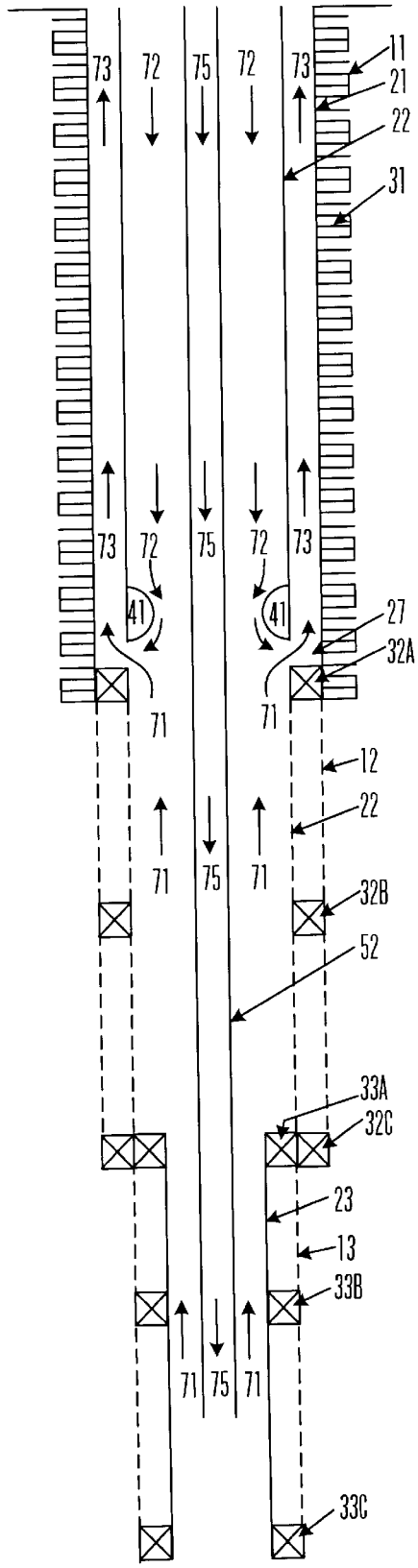

This objective is realized with lower volumetric rates of injecting the well control fluid down the inner casing 22 by either increasing the control fluid 72 viscosity or by providing an optional partial barrier with a decreased cross-sectional area of flow, as shown by the partial barrier 41 in FIGS. 1 and 2. For example, if a gelled water well-control fluid with a viscosity of 100 centipoise (CP) is used and if a barrier 41 with a flow area of 10% of the drillpipe annulus area 72 is used, then the injection rate for this control fluid would be only 1/10th of 1% (i.e., 0.001 fraction) of the rate needed for ungelled water (i.e., 1 cp) flowing down annulus 72 with no partial barrier 41. Typically, the hydrodynamic well control fluid has a viscosity ranging from about 10 to about 70 cp, and a specific gravity ranging from about 1.0 to about 1.5, If the an optional barrier 41 is used, the typical inner annulus adjacent to the barrier 41 may have a horizontal cross-sectional area ranging from about 2 to about 20% of the horizontal cross-sectional area of the inner annules above the barrier 41. However, in many well conditions these viscosities and densities may be higher or lower than these typical values and in many applications the optional barrier 41 is not used.

The partial-flow barrier 41 may consist of any one of many possible configurations, such as a simple, semi-circular cross-section, donut ring of flexible rubber, whose inside diameter is approximately the drill-pipe diameter, but deformable out to the drill-collar diameter, and whose outside diameter is formed by a steel ring designed to slide through the casing 22 and to be seated on a "no-go" stop in casing 22 located just above the H-BOP circulation port 27.

The flexible rubber donut is designed to permit a restricted, slow, bypass leakage of the downward flowing H-BOP control fluid in inner annulus 72 through the small cross-sectional area between the donut barrier 41 and the drill pipe (or drill collars) while drilling or tripping the drill string. In the small cross-sectional leakage area, the downward flow velocity will be high enough to prevent any of the produced formation gas in the annulus 71 below from migrating upwardly through the restricted by-pass area of the barrier 41 even when the volume flow rate of the annulus 72 H-BOP drilling mud is very low.

The flexible rubber donut 41 may be pulled out of the hole on top of the drill bit at the end of each trip of the drill string. A short length (e.g., 3 to 5 feet) of a special fluted drill collar designed with deep fluid by-pass grooves cut in its surface is positioned just above the drill bit. When the fluted drill collar is pulled up into the rubber donut partial barrier 41, it will provide a means for the drilling mud above the donut to easily flow past the donut barrier 41 to the area below the donut barrier. The fluid by-pass will prevent the donut barrier from swabbing the casing 22 as the donut barrier is being pulled out of the hole on top of the drill bit while tripping the drill string. Of course, the oil/gas-well tool design engineers who are skilled in the design, construction, and operation of similar down-hole, well-bore tools may provide many alternative and improved designs for this partial barrier 27 and for a means of by-passing the partial barrier 41 when tripping the drill bit out of the hole.

When the partial barrier 41 sitting on top of the drill bit is being tripped out of the hole, it may be useful to inject down the drill pipe a high-viscosity, high-strength, gel plug to fill the bottom few hundred feet of the casing 22 just above the circulation port 27. The high-viscosity, high-strength, gel plug will minimize the amount of downward flowing H-BOP fluid 72 needed to prevent the natural gas content of the produced formation fluids 71 from migrating by buoyancy up through the H-BOP fluid 72. The gel plug typically may have viscosity ranging from about 50 to about 500 cp and a specific gravity equal to the specific gravity of the hydrodynamic control fluid previously used in the inner casing.

However, if gas does migrate through the H-BOP fluid 72 and reaches the well head, then the regular BOP or the RBOP can be closed while additional H-BOP fluids at higher downward velocity are pumped down the inner casing 22 to re-establish the down-hole H-BOP control of the well. Again, a high-viscosity, high-strength, gel plug can be circulated down the inner casing 22 to the depth of the circulation port 27 and thereby substantially minimize the future volume rate of injecting a H-BOP control fluid 72 to divert essentially all of the produced formation fluids out through the circulation port 27 into the outer annulus 73 and thereby maintain down-hole, H-BOP control of the well.

So long as the down-hole, H-BOP control of this well is maintained, the drill pipe or other tools may be tripped in or out of this well without any pressure on the inner casing 22 or well head and without using the surface BOP stack or any surface pressure containment or stripping equipment. However, throughout the pipe/tool tripping operation, the production of formation fluids out of the producing reservoir sands will continue unabated. The well is "never-killed" in the producing formations, even though the inner casing 22 above the circulation port 72 is dead with no pressure at the well head to impede tripping pipe and tools in or out of the hole.

Figure 3:
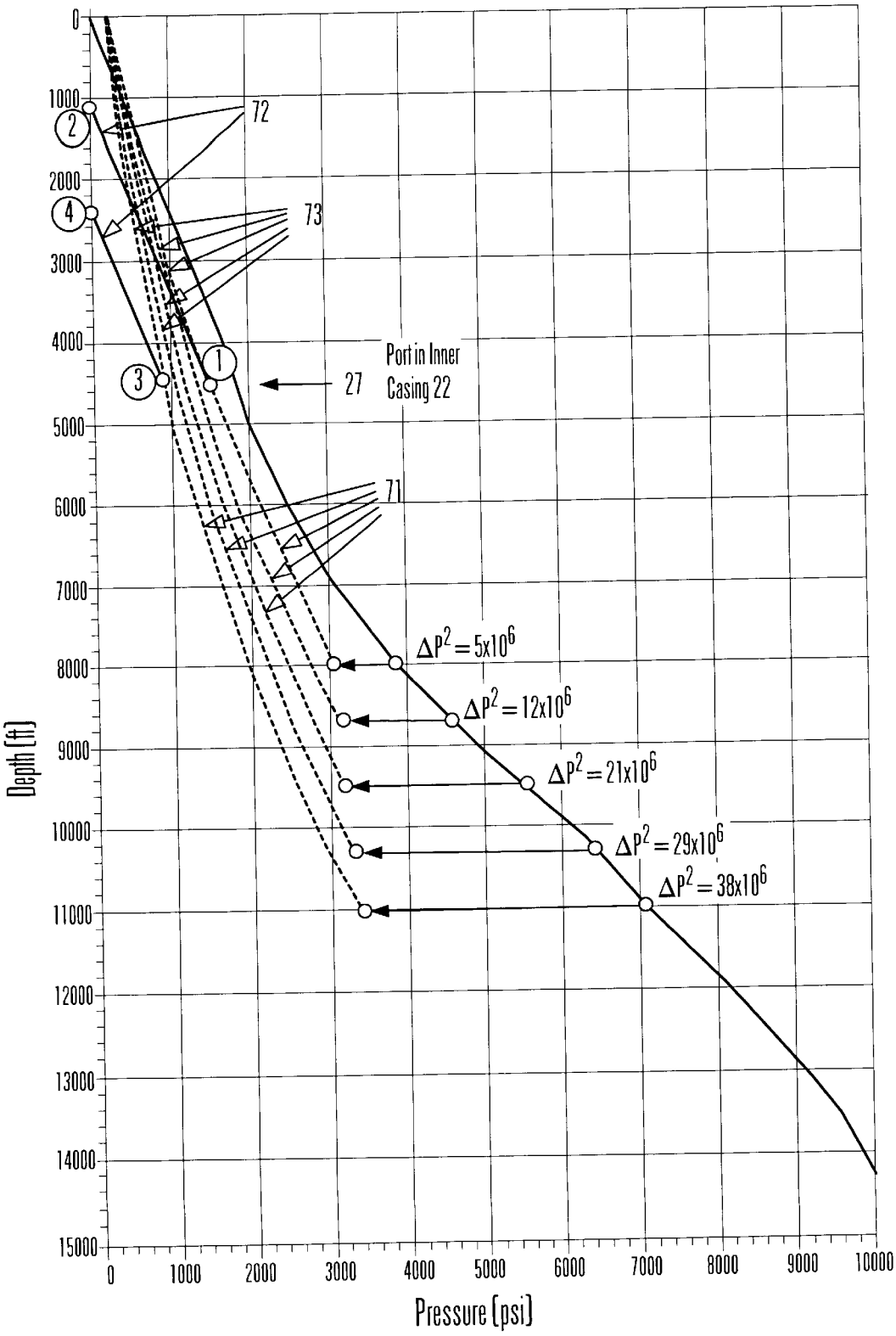
FIG. 3 illustrates an exemplary relationship between pressure and depth of the well-bore fluids which may be encountered during the drilling operation in the well.

FIG. 3 shows a series of typical pressure/depth profiles of formation fluid pressures and well-bore fluid pressures. The solid line in FIG. 3 represents a typical pressure/depth profile of formation fluids as found in many strongly overpressured, basin-centered, tight-sand gas resource areas. The dotted lines represent an example of the possible pressure/depth profiles of the well-bore fluids 71 consisting of a commingled mixture of produced formation fluids and drilling mud. The series of well-bore fluid curves 71 represent progressively increasing produced gas content from drilling at about 8,000-foot depth to drilling at about 11,000-foot depth. At the inner casing port 27, the upwardly flowing well-bore fluid 71 from below is commingled with the downflowing hydrodynamic well-control fluid 72 to create the commingled discharge fluid 73.

The discharge fluid 73 may have a low discharge pressure at the surface where the fluid 73 flows out to the burn pit to be vented to the atmosphere. Consequently, the fluid 73 will have a pressure located between point 1 and 3 (which correspond to the port 27 in the inner casing 22) in FIG. 3. Note that if the control fluid 72 is water or gelled water, it will have a pressure/depth gradient of about 0.433 psi/ft. of depth as shown by the line (1)/(2) and line (3)/(4) in FIG. 3. The pressure (1) or (3) at the port 27 in the inner casing 22 is determined by the pressure gradient in pressure/depth plot (FIG. 3) of fluid 73 from the surface at a near atmospheric pressure down to the depth of said port 27.

Then the control fluid 72, with a pressure gradient of about 0.433 psi/ft., will stand inside the inner casing 22 at a level (2) (e.g. at 1,100-foot depth) or (4) (e.g. at 2,500-foot depth) in FIG. 3, which is far below the well-head surface level. Consequently, the control fluid 72 will be pumped into the inner casing 22 at atmospheric pressure (i.e., at zero pressure or a vacuum) and will free fall down the casing 22 until it reaches the fluid level (2) (e.g., at 1,100-foot depth) or (4)(e.g., at 2,500-foot depth).

Consequently, the drill pipe and all of its attached equipment can be pulled out of casing 22 through the casing head, with zero fluid pressures. Also, there will not be any produced formation gas or other formation fluids coming to the surface through the inner casing 22 because all of the commingled drilling mud and produced formation fluids 71 have been diverted out through port 27 to flow up the outer annulus 73 and then have been discharged to the surface burn pit. The drill pipe and attached equipment may be pulled dry up through the well-control fluid 72 standing at a low level between the depth (2) (e.g., 1,100 feet) and (4) (e.g., 2,500 feet.)

Above the standing fluid level inside casing 22, the casing 22 contains air at atmospheric pressure. If significant gas enters the drill pipe through the drill-bit ports, while tripping the drill pipe, a mechanical or fluid gel plug can be set inside the drill pipe to prevent gas entry and gas migration. During the tripping of this pipe, the formation gas and other fluids continue to be produced out of the formation at under balanced pressures, and no well-bore fluids will be injected into these formations to cause formation damage. The well is thus not killed while drilling or tripping.

FIG. 1-B illustrates the application of the "Down Hole Hydrodynamic Well Control Blowout Prevention" invention to the completion and post-completion operations in the well with the same objective of not killing the well during any part of such operations. In FIG. 1-B, a production casing 23 is run to the total depth (TD), or a plugged back total depth (PBTD), without killing the well by using the same system previously described and illustrated in FIG. 1-A for tripping the drill pipe. This production casing 23 may be cemented from TD or PBTD up to a position below the depth of the casing 22 or, alternatively, a series of external casing packers (ECP) 33A, 33B, 33C, 33D, and 33E may be set to isolate segments of the open hole for testing and open-hole completion.

The production casing 23 may be either a full length casing or may be a casing liner 23 hung and sealed 33A at the base of the prior inner casing 22, as shown in FIG. 1-B. If a full length production casing 23 is used, then it may have an open circulation port directly opposite port 27 in casing 22. If the production liner from TD (or PBTD) up to the base of the prior positioned inner casing 22 is used, then the circulation port 27 in casing 22 can be used for this hydrodynamic well control function, just as previously described and as shown in FIG. 1-B.

If high pressure well fracturing operations are used in the well completion process and, if the outer casing 21 does not have an adequate pressure rating, then a fracture casing, like the casing 23, can be run, without killing the well, to tie into and seal onto the casing liner 23 for the well fracturing operation. Furthermore, the fracture casing can be subsequently removed, if desired, without killing the well.

A work-over tubing string 52 can be run in and out of the completed well, as shown in FIG. 1-B, without killing the well production. Many of the down hole work-over operations can be conducted in this manner without killing the well and thereby damaging the formation adjacent to the well bore and/or the formation adjacent to the hydraulic fractures extending from the well bore.

FIGS. 2-A and 2-B illustrate an alternative configuration for drilling and completing a well using a larger diameter intermediate depth hole 12 covered by an intermediate diameter casing or hung liner 22 covering that portion of hole and then a smaller diameter deeper hole 13 is drilled in which the smaller diameter casing liner 23 is hung. This configuration in FIG. 2 is especially desirable when the intermediate zone from the bottom of the outer casing 21 to the bottom of the intermediate casing (or liner) 22 has significantly different reservoir fluids and/or reservoir rocks requiring different evaluation procedures than the deeper zone 13 below the bottom of the intermediate casing (liner) 22.

The down hole, hydrodynamic, well control procedure above the bottom of the outer casing 21 is essentially, the same in both FIGS. 1 and 2. As described above in reference to FIG. 1, the well control in FIG. 2 involves the same downward flow of a well control fluid 72 inside the inner casing 22, around the optional partial barrier 41, where it is commingled with the upward flowing well-bore fluids 71, and both fluids 71 and 72 then flow out through the open port 27 and up the outer annulus 73 to exit out through a control manifold to the surface burn pit. The control of these fluid flows in the passages 71, 72, and 73 in FIGS. 2-A and 2-B will be substantially the same as described above in reference to FIGS. 1-A and 1-B.

Figure 4A:
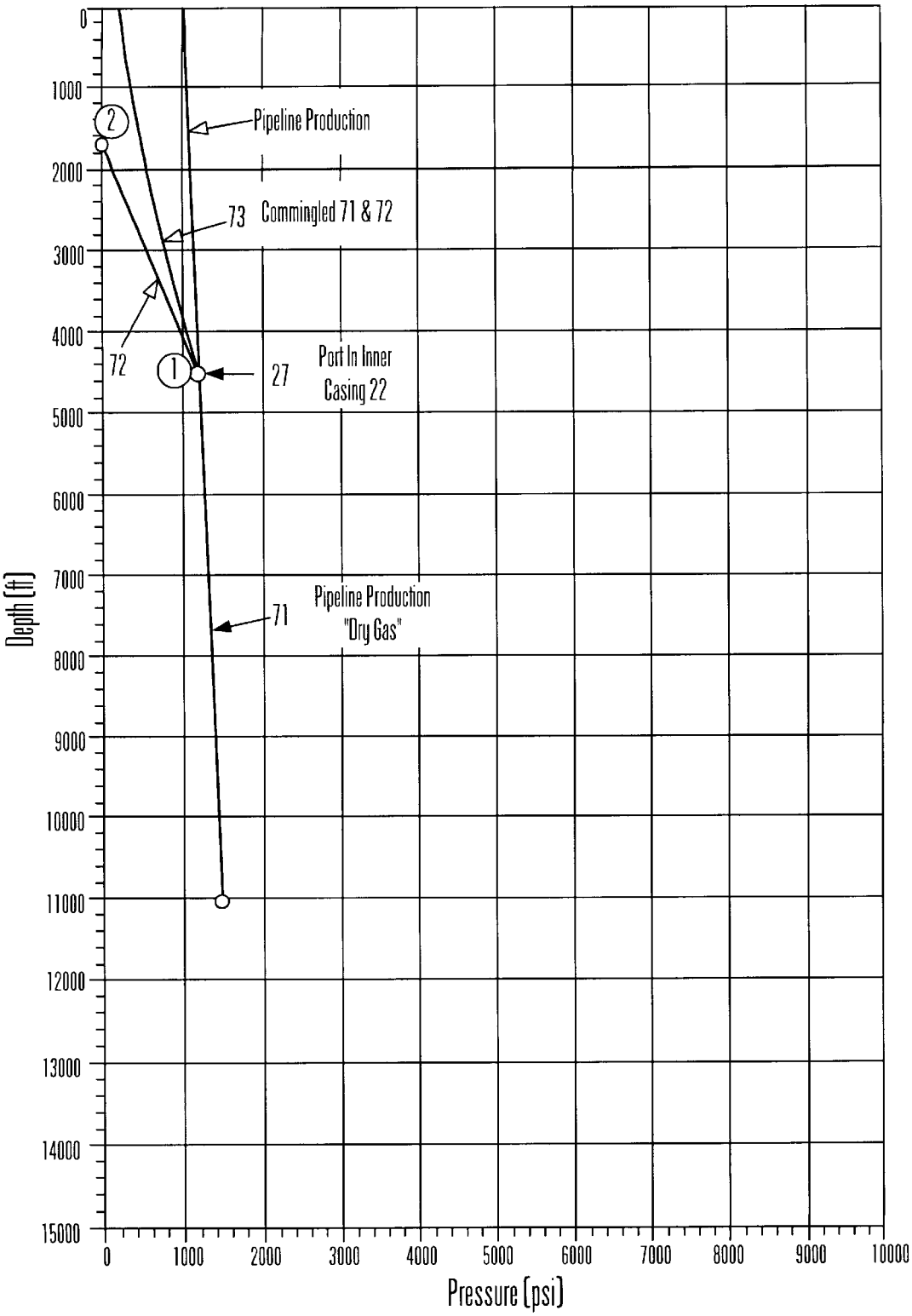
FIG. 4A illustrates an exemplary relationship between pressure and depth of the well-bore fluids while using the methodology of the present invention during the completion, production, and work-over operations in a producing gas well and shows this relationship for a "dry-gas" producing well.
Figure 4B:
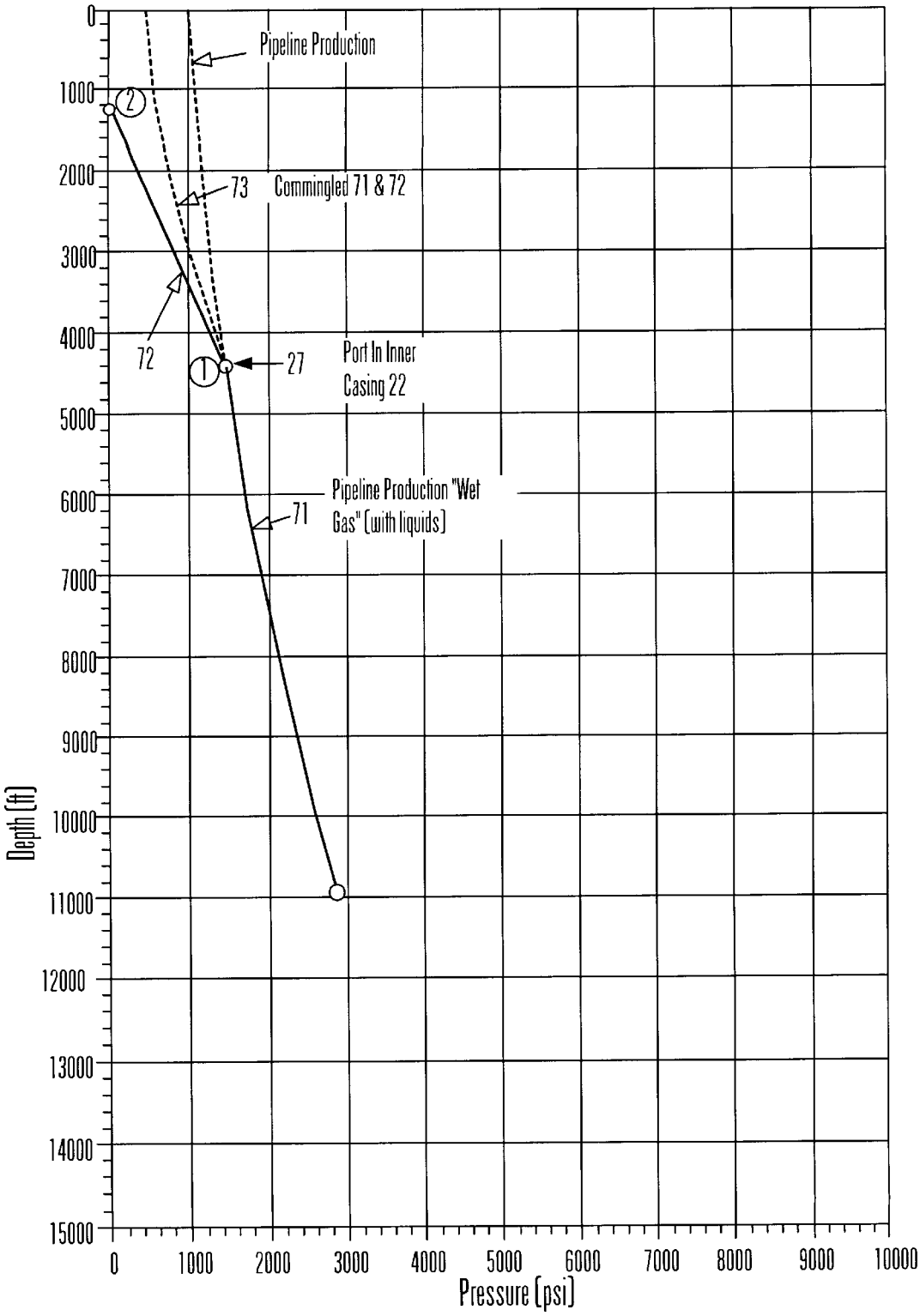
FIGS. 4-B and 4-C show the relationship between pressure and depth of the well-bore fluids for a "wet-gas" producing well containing liquid condensates and/or water.
Figure 4C:
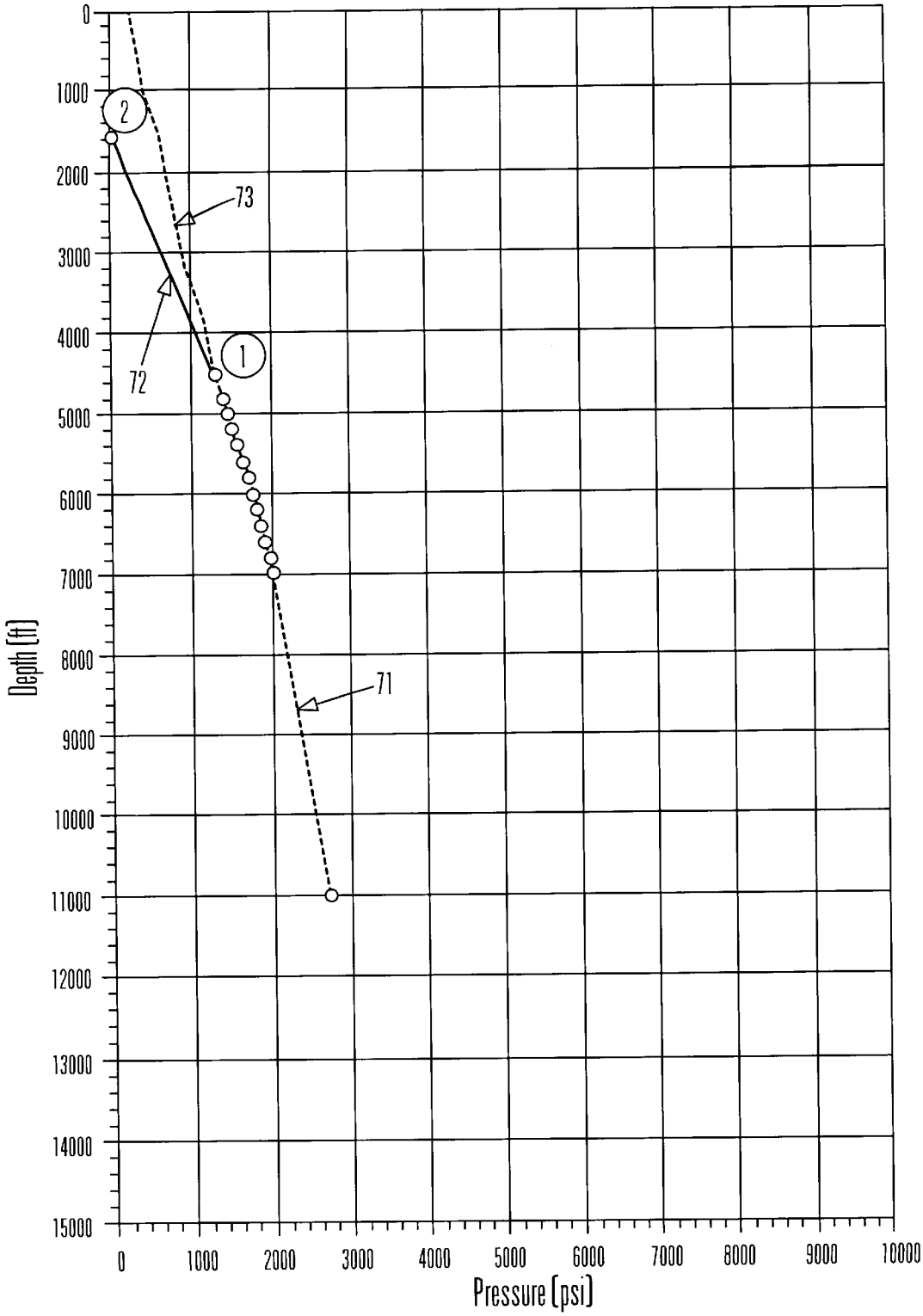
Figure 5:
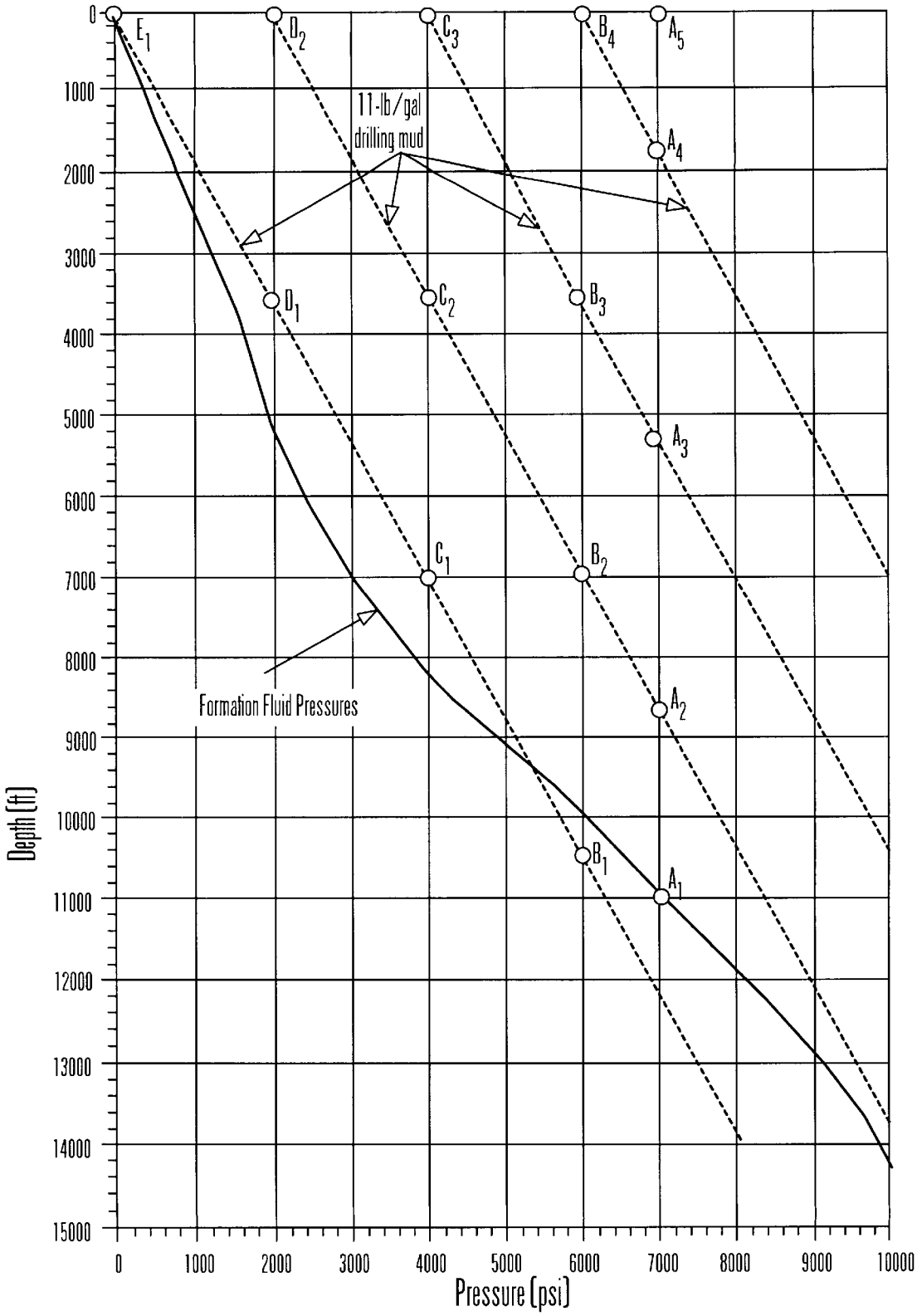
FIG. 5 illustrates an exemplary pressure versus depth relationship in the absence of the present invention during snubbing operations on a drilling well.
Figure 6:
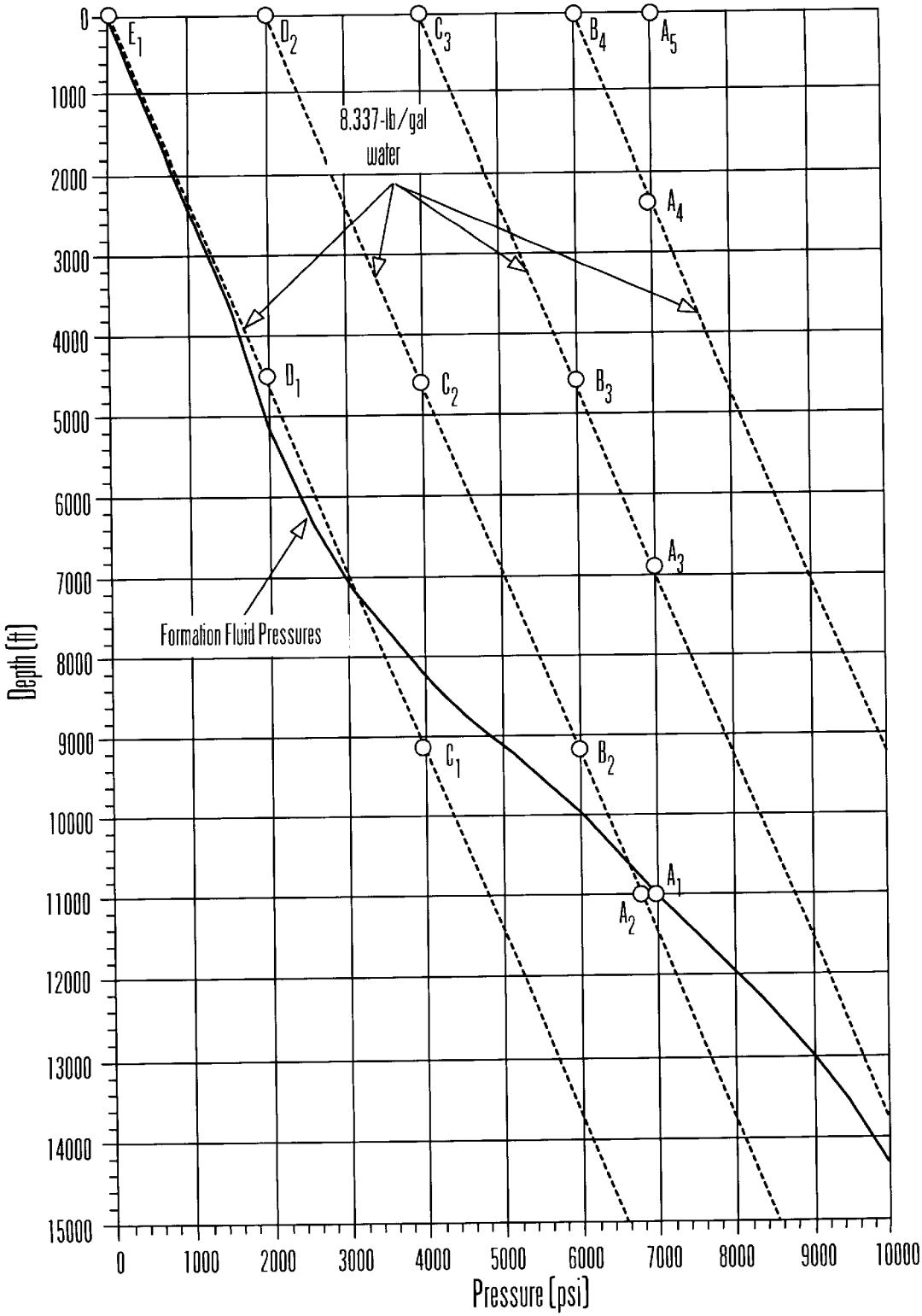
FIG. 6 illustrates an exemplary pressure versus depth relationship in the absence of the present invention during snubbing operations on a well undergoing completion operations.
Figure 7:
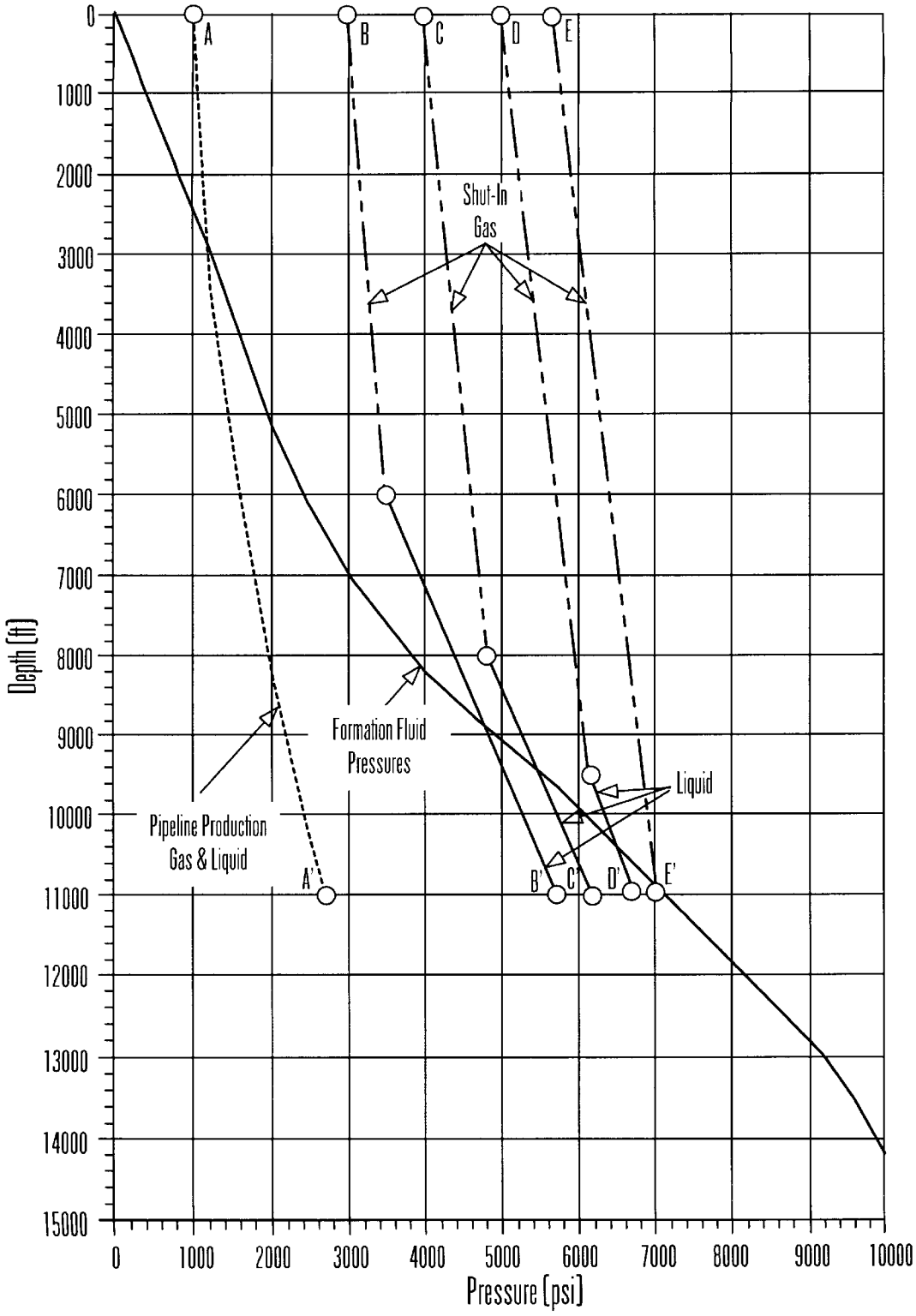
FIG. 7 illustrates an exemplary pressure versus depth relationship in the absence of the present invention in a "wet-gas" producing well during shut-in operations of a producing well.

FIGS. 3–7 and 9–11 show the typical pressure-depth profiles of well-bore fluids (a) during drilling operations (FIG. 3), (b) during steady-state gas production (FIG. 4), and (c) during snubbing or surface BOP shut-in fluid containment operations in a well bore containing 11 lb./gal drilling mud (FIG. 5), water (FIG. 6), or wet gas with liquid column water (FIG. 7). The methodology of the present invention prevents the damage to the reservoir rocks or formation fluids, as illustrated in FIGS. 1–4. In contrast, FIGS. 5–7 show how the reservoir productivity can be damaged by shutting in a producing well or by shutting in the annulus flow of a drilling well or well during completion by using a BOP, a rotating BOP, or a snubbing unit to contain the pressurized, shut-in well-bore fluids in the annulus.

When containing the pressurized well-bore fluids in the annulus by shutting in the blow-out preventer (BOP) or by snubbing the drill pipe or production tubing through a rotating blow-out preventer (RBOP) or a snubbing unit, the bubbles of gas subsequently migrating upward in the annulus well-bore fluid may create very high annulus pressures, as may be described by reference to FIG. 5. For example, if a well is drilling at about 11,000 feet with 11 lbs./gal drilling mud, then the formation gas at 7,000 psi in FIG. 5 will flow into the drilling mud at 6,300 psi.

In this slightly under balanced drilling condition, the 11-lbs/gal mud will be somewhat gaseated while circulating, resulting in the mud carrying gas, creating a combustion flare out of the mud discharge line in the combustion mud pit at the surface. This flow of gas out of the formation will decrease the gas pressure in the formation, resulting in decreasing gas flow rates into the drilling mud. If the drilling operation is stopped but the mud circulation is continued preparatory to pulling the drill pipe out of the hole (i.e., tripping the pipe) then the diminishing rate of gas flow into the mud results in a decreasing content of gas in the annulus drilling mud. When the circulating mud has very little gas content, then the drilling mud circulation may be discontinued and the drill pipe tripping operation may be started with the well production appearing to be totally dead (i.e., killed).

Because of the formation gas pressure drawdown of the gas in the formation rock near the well bore by the prior gas production into the mud, the rate of gas flow into the annulus mud column of the nearly dead well may be very slow. However, this slow flow of formation gas into the annulus will create a growing gas bubble in the drilling mud which may range from a few feet to a few hundred feet in height. This low-density gas bubble will start migrating upwardly through the annulus mud column, and the drilling mud will develop a by-pass channel to flow downward around the rising gas bubble. If the top of the annulus is open for discharge into the mud pit, then the mud will start flowing out of the annulus and into the mud pit as the rising gas bubble expands.

As this gas bubble migrates upwardly through the annulus mud column, it expands in volume, thereby increasing the discharge of mud out of the annulus and into the mud pit. If this process were allowed to continue, the rising and expanding gas bubble would blow a large volume of the drilling mud into the mud pit, resulting in a partially emptied annulus and a low mud pressure at the bottom of the hole. This would increase the flow of formation gas into the annulus, resulting in a much bigger gas bubble forming at bottom and rising up to annulus to unload more mud, ultimately resulting in a well blow out.

To prevent this unloading of drilling mud, the driller will prevent annulus mud flow by closing the BOP, or stopping the discharge from under the RBOP or snubbing unit. Consequently, the shut-in annulus mud pressure will rise as the gas bubble migrates upward in the annulus drilling mud.

If the top of the annulus is shut in and if the formations in the open hole below the lowest casing or liner are very low permeability into which the drilling mud cannot easily penetrate, then the gas bubble migrating up through the drilling mud will not be able to expand. Consequently, this non-expanding rising gas bubble will maintain the same pressure as it had down hole when the annulus was shut-in.

For example, in FIG. 5, if the top of the annulus is shut in with a solid column of 11.0 lb/gal drilling mud in the annulus, and if a gas-saturated formation at 11,000-foot depth in the open-drill-hole produces a 7,000 psi gas bubble in the drilling mud, then that non-expandable gas bubble would migrate upwardly by buoyancy at a constant 7,000 psi. When this upwardly migrating gas bubble reaches a depth of about 8,700 feet, the shut-in surface drilling mud pressure will be about 2,000 psi and the down-hole drilling mud pressure at 11,000 feet will be about 8,300 psi, as shown in FIG. 5. If the open-hole formations have such low permeability that this high pressure mud leak-off into the formations is small compared to the bubble size and the rate of upward migration of the 7,000 psi non-expanding gas bubble, then when this 7,000 psi gas bubble reaches the 5,200-foot depth in the well-bore annulus, the surface mud pressure will be about 4,000 psi and the down-hole mud pressure at 11,000 feet will be about 10,300 psi.

At this down-hole pressure, a hydraulic fracture probably will be initiated in some of the open-hole formations, thereby removing some of the mud from the annulus and allowing the upward migrating gas bubble to expand without further increase of mud pressure. If such hydraulic fracture would not occur, then the upward migrating gas bubble would arrive at the surface at its original 7,000 psi, thereby creating a 11,000-foot depth down-hole pressure of about 13,300 psi which would be far in excess of the pressure at which an any normal sedimentary formation would hydraulically fracture. In fact, at a far lower pressure, the porosity matrix and natural fractures of many gas sands would be invaded by drilling mud fluid, thereby removing mud from the annulus, allowing the gas bubble to expand, and limiting the rise in mud pressure.

Under these circumstances, the driller or drilling engineer may discharge to the mud pits such volume of drilling mud as may be necessary to limit this surface drilling mud pressure to some presumed safe value. For example, if 2,000 psi is selected as the maximum value for the surface mud pressure, then, when the upward migrating 7,000 psi gas bubble reaches the depth of about 8,800 feet (at position $A_2$ in FIG. 5) and the surface annulus mud pressure reaches about 2,000 psi (at position $D_2$ in FIG. 5), sufficient volume of drilling mud is discharged out of the annulus (below the closed BOP, RBOP or snubbing unit) to the mud pit to prevent this pressure from exceeding 2,000 psi. Consequently, this expanding gas bubble would expand to a pressure of 6,000 psi at 7,100-foot depth ($B_2$ in FIG. 5,) a pressure of 4,000 psi at 3,500-foot depth ($C_2$ in FIG. 5)and to a pressure of 2,000 psi at the surface ($D_2$ in FIG. 5).

When the expanding gas bubble reaches the surface at 2,000 psi, the gas is slowly discharged to the mud pit and, simultaneously, drilling mud is pumped into the annulus at 2,000 psi to replace the volume of the 2,000 psi gas bubble discharged from the annulus. By this means, the upward migrating gas bubbles can be worked out of the annulus mud column in such manner which will prevent additional gas bubbles from being produced out of the formation and flowing into the annulus mud column.

Consequently, the well is successfully killed by creating down-hole annulus drilling mud pressures which are at all depths significantly higher than the gas pressures in every open-hole formation. The process of killing the well by overpressure, as shown in FIG. 5, results in pushing some drilling mud into the formation pore spaces and fractures and thereby damaging the productivity potential of those formations. As shown by the example of 11-lbs./gal drilling mud with a surface pressure of 2,000 psi creates an overpressure (i.e., mud pressure minus formation pressure) ranging from 500 psi at 14,000 feet, 1,000 psi at 12,000 feet, 1,500 psi at 10,000 feet, 2,000 psi at 9,000 feet, 2,500 psi at 8,700 feet, and 3,000 psi at 7,000 feet. The depth of invasion of the drilling mud into the formation porosity matrix and, the formation pre-existing natural fractures, and thereby the damage of formation productivity, is dependent in part on the degree of overpressure created in killing the well, as shown in FIG. 5 and described above.

The process of containing pressurized well-bore fluids under the BOP, RBOP or snubbing unit during well completion operations, using water as the well-bore circulating fluid, is very similar to the above description and the referenced FIG. 5, except that the pressure gradient for water is used instead of the drilling mud pressure gradient. FIG. 6 shows these same pressure-depth relationships as in FIG. 5, except that the water pressure gradient replaces the drilling mud pressure gradient. By using FIG. 6 instead of FIG. 5, the same physical analysis can be made for a water filled annulus pressure containment process during well completion operations, as previously described for a drilling well operation and illustrated in FIG. 5.

FIGS. 5 and 6 and the above description thereof illustrate the operational problems which exist in wells on which the present invention described herein is not used. These problems of well control and formation damage during drilling and completion, as described in reference to FIGS. 5 and 6, are eliminated by using the present invention, as described in reference to FIGS. 1, 2, 3, and 4 herein.

Also, the methodology of the present invention has great value for use in work-over operations in wells subsequent to a period of production. If any liquid condensate or water is present in the well bore, then the shut-in pressure profile of the well-bore fluid may be about as shown in FIG. 7. Note, that with the progression of time from curve A–A', to B–B' to C–C', to D–D' of FIG. 7, this liquid condensate and/or water is being injected into the gas producing porosity zones. The liquid injection may create pore throat liquid blockage which greatly reduces the relative permeability to gas from these gas producing sands. In many of the ultra-tight (i.e., low-permeability) sandstone reservoirs, the great majority of pore throats may have radii of only about 0.1 to 0.4 microns. In these tight sands, any liquid injected into these pore spaces with pore throats of only 0.1 to 0.4 micron radii will create a gas flow blockage which may require a very high pressure gradient to remove the liquid blockage before any gas flow can occur.

If both hydrocarbon condensate and water are injected into such tight sands, a very difficult to break, three phase, flow blockage may occur, effectively destroying the ability of those sands to produce any gas. For example, a typical tight gas sand reservoir rock may have an initial effective permeability to gas of about 50 to 500 microdarcys (i.e., 0.05 to 0.5 md) prior to invasion of any well-bore fluids. After invasion of well-bore water into these pore spaces, the effective permeability to gas may be reduced to about 5 to 20 microdarcys. If these pore spaces are invaded by both water and liquid condensate to create a three-phase flow blockage, the effective permeability to gas may be reduced to almost zero. Therefore, it is extremely important to prevent the injection of condensate and/or water into these sands, as illustrated in FIG. 7.

EXAMPLE 1

For the purpose of under balanced drilling and producing the Lance overpressured sands from about 7,500 feet to about 11,000 feet (or deeper), in the Sublette County, Wyo., portion of the Green River Basin, the following drilling/casing design may be used to provide the means for achieving this down hole, hydrodynamic blow-out-preventer (H-BOP) operation, as illustrated in the attached FIG. 2:

| | Depth | Hole Size | Casing Size | Annulus Area |
|---|---|---|---|---|
| A. | 0–4,500 feet | 12¼" | 9⅝"(40#) | Cement to surface |
| B. | 4,500'–7,500' | 8¾" | | (HBOP @ 4,500' in 7⅝") |
| | 0–4,500' casing | | 7⅝" – XL (26.4#) | .1086 $ft^2$ = 15.6 $in^2$ |
| | 4,500'–7,500' casing | | 7" (23#) | .1508 $ft^2$ = 21.7 $in^2$ |
| C. | 7,500'–11,000' + | 6¼" | | |

-continued

| Depth | Hole Size | Casing Size | Annulus Area |
|---|---|---|---|
| 7,500'–11,000' (liner) | | 4½" (11.6#) | .1 to .2 $ft^2$ = 15 to 30 $in^2$ |

The procedure for drilling/casing this well to achieve under balanced drilling and work-over operations of the gas-producing Lance sands from 7,500 feet to 11,000 feet (or deeper), as illustrated in FIG. 2, may be briefly described as follows:

(1) Set conductor to about 60± feet.

(2) Drill $12^{1/2}$" surface hole to about 4,500+ feet using water/mud with mica flakes to minimize water loss into the low-pressure, high-porosity sands in this section.

(3) Run open-hole logs (Array Induction and Neutron/Density logs).

(4) Run $9^{5/8}$" surface casing (40#/ft, C-95) to surface hole total depth and cement back to surface. Assemble and test BOP stack, consisting of a DBOP at bottom, plus a Rotating BOP (R-BOP) on top.

(5) Drill $8^{3/4}$" hole from about 4,500 feet into top of Lance at about 7,500 feet using from 100 to 200 scf compressed air per barrel of water/mud to give a 12% to 25% aerated mud at about 2,000 psi bottom-hole pressure. Use Rotating BOP (R-BOP) to divert aerated and gaseated mud out to burn pit without leakage of gaseated mud up to KB and derrick floor.

(6) Run open-hole logs (Array Induction and Neutron/Density logs) from total depth up to surface casing at about 4,500 feet.

(7) Run intermediate casing, as follows: (A) 7", 23#/ft, C-95 casing with ECP'S, as needed (i.e., no cement), from total depth at about 7,500 feet up to about 50 feet above base of $9^{5/8}$" surface casing. (B) $7^{5/8}$", 26.4#/ft, C-75 casing from top of 7" casing up to the surface well head. (C) Place a large circulation port near the bottom of the $7^{5/8}$" casing for use as the Alpine, down-hole, hydrodynamic BOP (i.e., H-BOP).

(8) Drill $6^{1/4}$" hole with lightly aerated water/mud from bottom of intermediate casing at about 7,500 feet down to the geologically selected total depth at about 11,000 feet (or deeper). When adequate formation gas flow is established, the aeration of mud can stop and natural formation gas flow will maintain a gaseated under balanced mud system throughout the balance of this drilling operation. The H-BOP at 4,500-foot depth will permit tripping drill pipe and running casing with under balanced gaseated mud system without killing the well at anytime.

(9) Run open-hole logs from total depth up to bottom of the intermediate casing at about 7,500 feet.

(10) Run $4^{1/2}$", 11.6#, P-110 casing liner to hole total depth and hang this liner on the bottom of the 7" intermediate casing@ at about 7,500 feet, using down-hole H-BOP to maintain under balanced gaseated mud system without killing the well. Proceed with completion program as designed for each well.

The procedure for under balanced drilling of the $6^{1/4}$" hole described in step #8 above is illustrated in the attached FIG. 2-A for drilling wells and FIG. 2-B for completed and producing wells. In reference to FIG. 2-A, the slightly aerated drilling water/mud is pumped down the inside 75 of the drill pipe 51, then out through the drill bit 53 and up the annulus 71. For example, in reference to FIG. 3, if the aerated drilling mud pressure at 8,000-foot drilling depth is about 3,000 psi (i.e., about 200 atm), then the injection of about 875 scf/min (i.e., about 1,250,000 scud) of compressed air into the 7 b/m stream of drilling mud at the surface mud pump will create a 10% aerated mud with a pressure gradient of about 0.39 psi/ft at 3,000 psi in the annulus just above the drill bit. This 10% compressed air will expand to 15% of the mud volume at about 6,000-foot depth and further expand to 20% of the mud volume at about 4,500-foot depth, resulting in proportionately reduced pressure gradients at these shallower depths, as illustrated in the attached FIG. 3.

Any porous sands containing formation gas penetrated by the drill bit with this under balanced aerated mud system will produce formation gas into the annulus to further gasify and reduce the weight of this drilling mud. This relationship of formation pressure and well-bore pressures is illustrated in the attached FIG. 3 for the under balanced drilling of a Lance gas producing well.

Notice that at 4,500-foot depth, the 20% (or higher percentage) gaseated drilling mud in the annulus will have a pressure of only about 1,500 psi or less, which is about 450 psi below the normal hydrostatic pressure for this depth. Therefore, if a solid column (i.e., not gaseated) of drilling mud with a density slightly greater than water (i.e. about 8.75 lbs/gallon) is pumped down the annulus 72 between drill pipe 51 and the $7^{5/8}$" casing 22, as shown in FIG. 1, then the pressure/depth profile of this drilling water/mud column will be about in FIG. 3. This pressure/depth plot as shown by the heavy line from (1 to 2 in the water column 72 (FIG. 3) runs from about 1,500 psi at a depth of about 4,500 feet (1 up to a zero gauge pressure (atmospheric pressure) at a depth of about 1,200 feet below the surface 2 as shown in FIG. 3.

Consequently, the drilling mud being pumped into annulus 72 at atmospheric pressure will free fall down this annulus 72 to the fluid level (2 found at about 1,200-foot depth (FIG. 3). As additional drilling mud is pumped into annulus 72, then this volume rate of drilling mud flowing down annulus 72, flows out through the H-BOP circulation port 27 at about 4,500 feet where it is commingled with the gaseated drilling mud 71 from below. Then the resulting commingled fluids (i.e., 71 and 72) will flow up annulus 73 between the $7^{7/8}$ inner casing and the 9 ⅝" outer casing. When these commingled fluids 73 reach the surface, they are discharged to the burn pit at approximately atmospheric pressure.

If the velocity of the H-BOP drilling mud flowing downward in the annulus 72 exceeds the velocity of gas bubbles or gas slugs attempting to migrate upward by buoyancy in this drilling mud, then all of the gaseated mud 71 and its gas content will be diverted out through the H-BOP circulation port 27 into annulus 73. Consequently, none of the formation gas (or mud aeration) from annulus 71 drilling mud will be able to migrate up through the downflowing drilling mud to escape at the surface from this annulus 72 just below the derrick floor. Under these conditions, the drill pipe can be tripped in and out of the hole through the open-ended, zero-pressure, $7^{5/8}$" casing 22 (i.e., without stripping under pressure) while the hydrodynamic control fluid flows down annulas 72 to circulation port 27 and the produced formation gas continues to flow upward through the annulus 71 out through the circulation port 27 where the hydrodynamic control fluid in annulus 72 commingles with the formation gas in annulus 71 and these commingled fluids then flow upward through annulus 73 to the surface for discharge to the burn pit.

For the purpose of reducing the volume rate of injecting the water/mud into the $7^{5/8}$" casing 22 for H-BOP fluid downflow control through annulus 72, a fluid-flow-restriction or partial-flow-barrier 41 (FIG. 1) may be inserted in the annulus 72 just above the H-BOP circulation port 27. This partial-flow-barrier may consist of any one of many possible configurations, such as a simple, semicircular cross-section, donut ring of flexible rubber, whose inside diameter is approximately the drill-pipe diameter, but deformable out to the drill-collar diameter, and whose outside diameter is formed by a steel ring designed to slide through the $7^{5/8}$" casing 22 and to be seated on a "no-go" stop in casing 22 located just above the H-BOP circulation port 27.

This flexible rubber donut is designed to permit a restricted, slow, bypass leakage of the downward flowing H-BOP drilling mud in annulus 72 through the small cross-sectional area between this donut barrier and the drill pipe (or drill collars) while drilling or tripping the drill string. In this small cross-sectional leakage area, the downward flow velocity will be high enough to prevent any of the produced formation gas in the annulus 71 below from migrating upward through this restricted by-pass area of this barrier 41 even when the volume flow rate of the annulus 72 H-BOP drilling mud is very low.

This flexible rubber donut 41 may be pulled out of the hole on top of the drill bit at the end of each trip of the drill string. A short length (i.e., 3 to 5 feet) of a special fluted drill collar designed with deep fluid by-pass grooves cut in its surface is positioned just above the drill bit. When this fluted drill collar is pulled up into the rubber donut partial barrier (41), it will provide a means for the drilling mud above the donut to easily flow past the donut barrier 41 to the area below the donut barrier. This fluid by-pass will prevent this donut barrier from swabbing the $7^{5/8}$" casing 22 as the donut barrier is being pulled out of the hole on top of the drill bit while tripping the drill string. In many operations, this partial flow barrier 41 is eliminated by substituting a high viscosity gelled water/mud plug emplaced in annulus 72, just above the circulation port 27, to accomplish this same objective of down-hole hydrodynamics (H-BOP) control with a low volume rate of hydrodynamic control fluid injection.

So long as the down-hole, H-BOP control of this well is maintained, the drill pipe or other tools may be tripped in or out of this well without any pressure on the $7^{5/8}$" casing 22 or well head and without using the surface BOP stack or any surface pressure containment or stripping equipment. However, throughout this pipe/tool tripping operation, the production of formation fluids out of the producing reservoir sands will continue unabated. This well is "never-killed" in the producing formations, even though the $7^{5/8}$" casing 22 above the circulation port 72 is dead with no pressure at the well head to impede tripping pipe and tools in our out of the hole.

As shown in FIG. 2-B, this same down-hole, H-BOP control of the well's continuous production, as described above for the drilling well illustrated in FIG. 2-A, can be maintained during completion operations and during work-over operations of a completed well. FIGS. 4-A, 4-B, and 4-C show the pressure depth profiles of the well-bore fluids 71, 72, and 73 during production of formation fluids and using the down-hole H-BOP for well control while running work-over tools in the well without killing or interrupting the production.

EXAMPLE #2

Figure 8A:
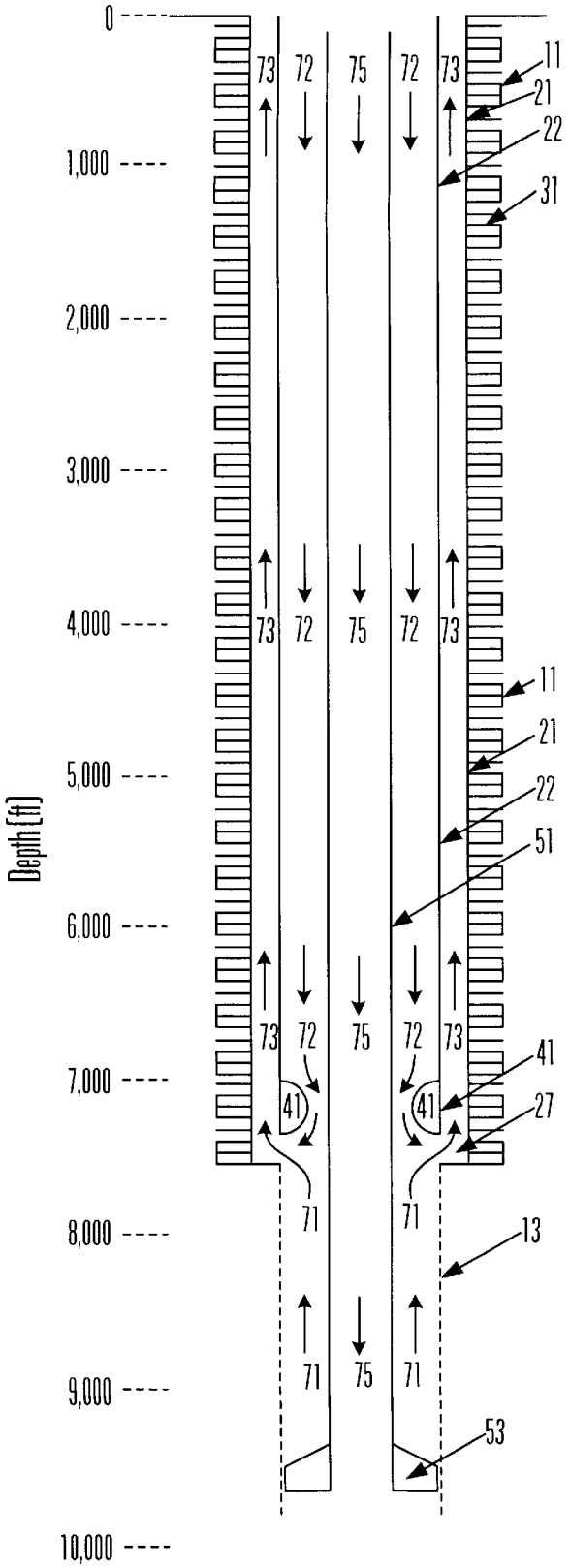
FIG. 8 depicts the well configuration of Example 2.

A second example of under balanced drilling and producing the Lance overpressured sands from about 7,500 feet to about 11,500 feet (or deeper) in Sublette County, Wyo., is a design for slimhole drilling with coiled tubing drilling equipment (See FIG. 8A). In this example, a 2" diameter coiled tubing 51 drilling system is used to drill a 4.25-inch diameter slim hole 13 out from under a 5" uncemented, inner, hydrodynamic-control (H-BOP) casing 22 hung to 7,500-foot depth inside a 7 inch (23#) outer casing 21 set to 7,500-foot depth. (NOTE: This same H-BOP control system can be used on a conventional drilling rig with conventional jointed drill pipe and with the same 4.25" diameter drill bit and bottom-hole assembly as an alternative to the coiled tubing drilling system described herein.)

Any desired drilling procedure and casing program may be used to drill this hole to the top of the overpressured Lance formation at about 7,500-foot depth and to set a 7" O.D. (23#/ft.) casing 21 to this drill-hole depth of about 7,500 feet. Drill out the cementing shoe and any cement inside the 7" casing down through the bottom of this casing and to the bottom of the prior drill hole. Then the 5" O.D. (15#/ft.) hydrodynamic-control, inner casing (HBOP) 22 is run in hole and hung uncemented from the casing head to the bottom of the prior drill hole at or below the bottom of the 7" casing. Within the bottom two feet of this 5" O.D. H-BOP casing a series of about 8 holes 27 of about 1.5 inches diameter are drilled through this casing wall in a pattern which will maintain the maximum structural strength of this casing. A centralizer collar may be used on this 5" H-BOP casing 22 inside the 7" outer casing 21 to hold this H-BOP casing in a constant centralized position.

The cross-sectional area of the annulus 73 between the inner H-BOP 5" casing and the outer 7" casing is about 12.2 sq. in. This is about the same cross-sectional area as the annulus 71 between the 2" coiled tubing drill string and the 4.4 inch average diameter of the open hole 13 drilled by a 4.25" diameter drill bit 53. Therefore, the velocity of flow of the well-bore fluids upward (1) through the open drill hole annulus 71, (2) diverted out through the 8 holes of 1.5 inch diameter near the bottom of the 5" casing 27, and then (3) upward through th e H-BOP annulus between the 5" inner casing and the 7 inch outer casing will remain nearly constant.

However, the injected hydrodynamic-control fluid flowing down the annulus 72 between 2" coiled tubing drill pipe 51 and the 5" inner casing 22 commingles with the upward flowing open-hole wellbore fluid as they flow together out through the 1.5" holes 27 near the bottom of the 5 inch casing. Consequently, there is an increased velocity of flow of the resulting commingled fluid upward through the H-BOP annulus between the 5" and 7" casings. The pressure depth profile (See FIG. 9) in the H-BOP annulus 73 between the 5" and 7" casings will be controlled by (1) the surface pressure of the commingled fluids discharged from this H-BOP 73 annulus and (2) the volume flow rate of the hydrodynamic-control fluid 72 from inside the inner 5" casing being injected into this H-BOP annulus 73 where it is commingled with the well-bore fluids 71 flowing upward from the drilled open-hole section.

The objective of exercising these H-BOP controls is to establish the pressure at the bottom (1) of the inner 5" H-BOP casing to be equal to or less than the hydrostatic pressure plus friction pressure loss of the H-BOP control fluid 72 flowing down the inside of this 5" inner casing. When controlled in this manner, the well-head pressure in the annulus between the 2" coiled tubing drill string and the inner casing will be zero and the top of the fluid level standing in this annulus may be some distance below the surface. (2) In this properly H-BOP controlled condition, the drilling operations can proceed without using any well-head pressure control equipment for pipe stripping or snubbing operations. (NOTE: This H-BOP drilling operation, without using any special well-head pressure control stripping or snubbing equipment, is applicable to drilling with either a coiled tubing drill string or a conventional jointed drill-pipe drill string.)

If the top of the hydrodynamic-control fluid level (2) inside the inner 5" casing rises to the surface or starts to build any significant pressure under the conventional, low pressure, drilling rotating head, then the control valves on the surface discharge flow from H-BOP annulus can be opened to reduce the surface discharge pressure. This procedure will reduce the pressure depth profile 73 in the H-BOP annulus and thereby reduce the pressure at bottom (1) of the 5" inner casing and lower the fluid level inside the inner casing. Consequently, the volume rate of injecting the hydrodynamic-control fluid into this 5" inner casing can be increased, resulting in a higher rate of injecting this fluid into the H-BOP annulus where it is commingled with these annulus fluids. As more of the higher density hydrodynamic-control fluids 72 are injected into and become commingled (at the bottom 27 of the 5" inner casing) with the well-bore fluids flowing upward 71 from the drilling open-hole section, then the pressure gradient in this commingled fluid 73 in the H-BOP annulus will be increased, thereby restoring pressure control to this system.

If the well-head pressure inside the 5" inner casing becomes too high for safe operations with a low pressure rotating head, then the conventional surface BOP's can be closed and the rate of injecting the hydrodynamic-control fluid can be rapidly increased and, if needed, the density of this control fluid 72 can be increased until proper control of this well is restored. When this pressure control is established with a balanced rate of injecting the hydrodynamic-control fluid with a reasonable surface pressure of the commingled fluids 73 discharged from the H-BOP annulus, then the conventional well-head BOP can be opened and drilling operations can be resumed.

The velocity of flow upward through the open-hole drilled interval 71 and upward through the H-BOP annulus 73 needs to be sufficient to carry the drill-bit rock cuttings up hole to the surface. The upward flow velocity required to transport the drill cuttings depends upon the gel strength and viscosity of the liquids used and also depends upon the volume of gas produced from the formation during this under balanced drilling operation. As a rough guideline for estimating these velocities, the following table has been calculated for the liquid component only in this flow stream (i.e., the produced gas volume must be added to these calculated values):

| Drill Bit Mud Motor Flow Rate | Drilling Open-Hole Flow Vel. | H-BOP Annulus Flow Vel. | H-BOP Control Flow Rate | | H-BOP Annulus Flow Vel. |
|---|---|---|---|---|---|
| 0 gpm | 9 ft/m | 0 ft/m | 50 gpm | = | 79 ft/m |
| 0 gpm | 0 ft/m | 0 ft/m | 100 gpm | = | 158 ft/m |
| 80 gpm | 129 ft/m | 126 ft/m | 100 gpm | = | 284 ft/m |
| 100 gpm | 162 ft/m | 158 ft/m | 100 gpm | = | 316 ft/m |
| 110 gpm | 178 ft/m | 174 ft/m | 100 gpm | = | 332 ft/m |
| 130 gpm | 210 ft/m | 205 ft/m | 100 gpm | = | 363 ft/m |
| 150 gpm | 242 ft/m | 237 ft/m | 100 gpm | = | 395 ft/m |
| 180 gpm | 291 ft/m | 284 ft/m | 100 gpm | = | 442 ft/m |

In this tabulation, note that the H-BOP control flow rate is the volume rate of the liquid hydrodynamic-control fluid 72 flowing downward through the annulus 72 between the 2" coiled tubing drill pipe and the 5 inch inner casing. The downward flow velocity of the HBOP control fluid must be greater than the upward buoyancy migration rate of gas bubbles or gas slugs in this fluid. Increased control fluid viscosity and gel strength will lower this gas migration rate and thereby decrease the control fluid volume rate of injection. Also, the hydrodynamic barrier 41 just above the 8 commingling by-pass holes 27 will provide this required downward flow velocity of the control fluid 72 at this point with substantially reduced volume rate of injection of this fluid 72. The example illustrated in FIG. 9 is based on using a good quality 11#/gal. drilling mud for injection both down the drill pipe 75 (inside 51) and down the H-BOP control fluid annulus 72 between the drill pipe 51 and the 5 inch H-BOP inner casing 22.

Figure 9:
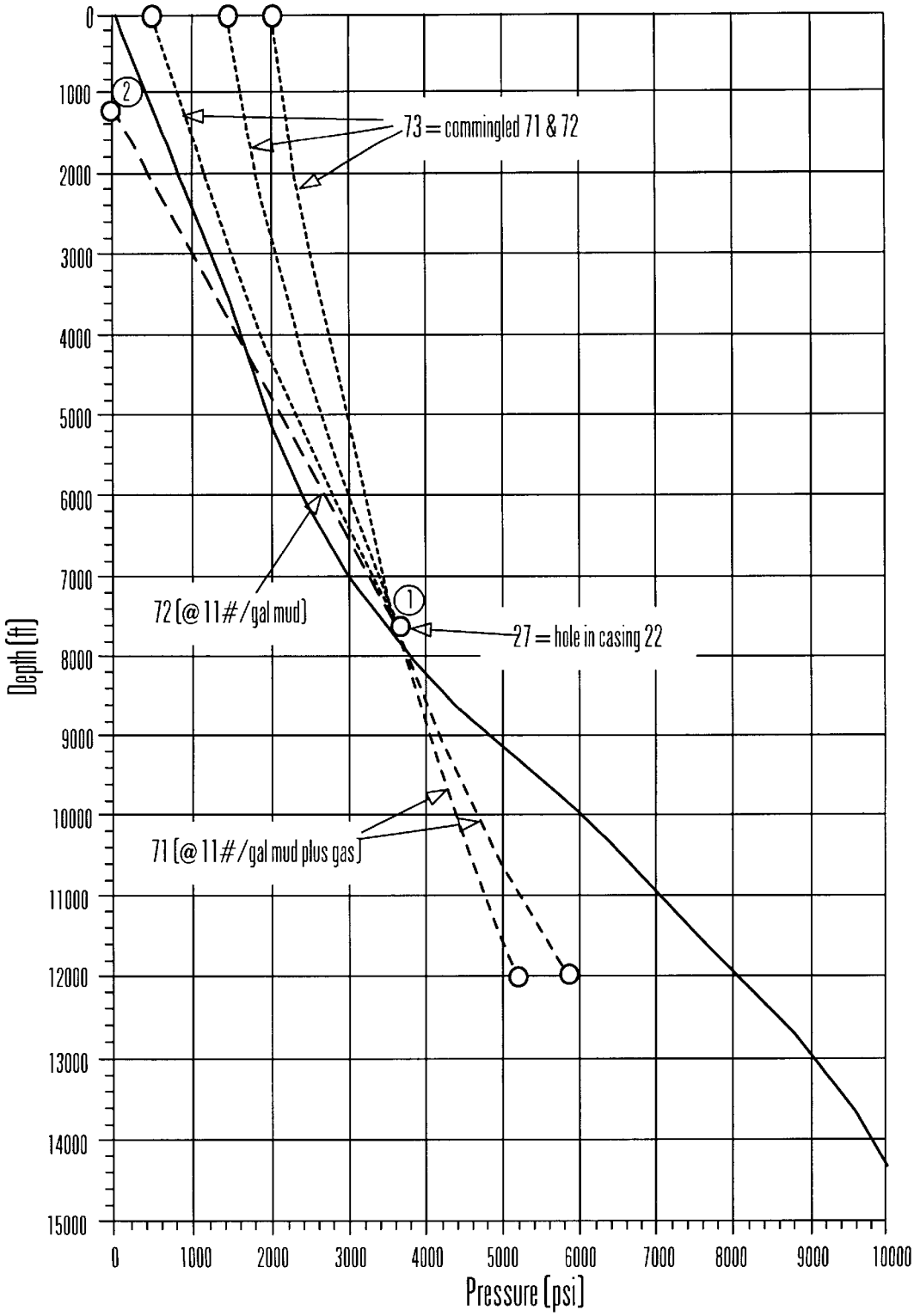
FIG. 9 illustrates the well-bore-drilling pressure profile of Example 2.

One of the objectives of this hydrodynamically controlled, down-hole, blow-out preventer is to establish a nearly fixed control pressure at the location of the commingled fluid mixing holes 27 near the bottom of H-BOP inner casing 22, as shown in FIG. 9. The H-BOP control fluid 72 is a drilling mud with sufficient density to create the pressure gradient from 1 at the commingled mixing hole location 27 to the top 2 of the control fluid column 72. This top of the control fluid column should be at a location below the well-head elevation, thereby resulting in a zero well-head pressure in the annulus 72 between the moving drill pipe and the stationary inner casing 22. Consequently, all drill pipe movement and operations can be conducted without using any stripping or snubbing pressure control equipment.

This down-hole H-BOP control system which maintains a nearly fixed control pressure 1 at location 27 in the casing will provide a controlled and continuous under balanced drilling environment between the two pressure profile curves 71 extending downward over the open-hole section below the location 27 of the fluid commingling mixing holes in the inner casing 22, as shown in FIG. 9. The higher pressure of these two open-hole pressure profile curves 71 represents a low volume rate of gas production (perhaps less than 1 mmcf/d), whereas the lower pressure curve represents a higher rate of gas production (perhaps several mmcf/d).

The commingling pressure profile curves 73 in the H-BOP annulus above the commingling mixing holes 27 represents three different combinations of gas production rates 71 and H-control fluid 72 injection rates commingled at the holes 27 in the inner casing 22. The discharge of the commingled fluids 73 at varying surface pressures is from t he annulus between casing 21 and casing 22, which does not require any pressure seals between any moving parts. Consequently, this surface discharge of the H-BOP annulus commingled fluids 73 through control manifold and valves can be at almost any pressure desired or required.

Figure 10:
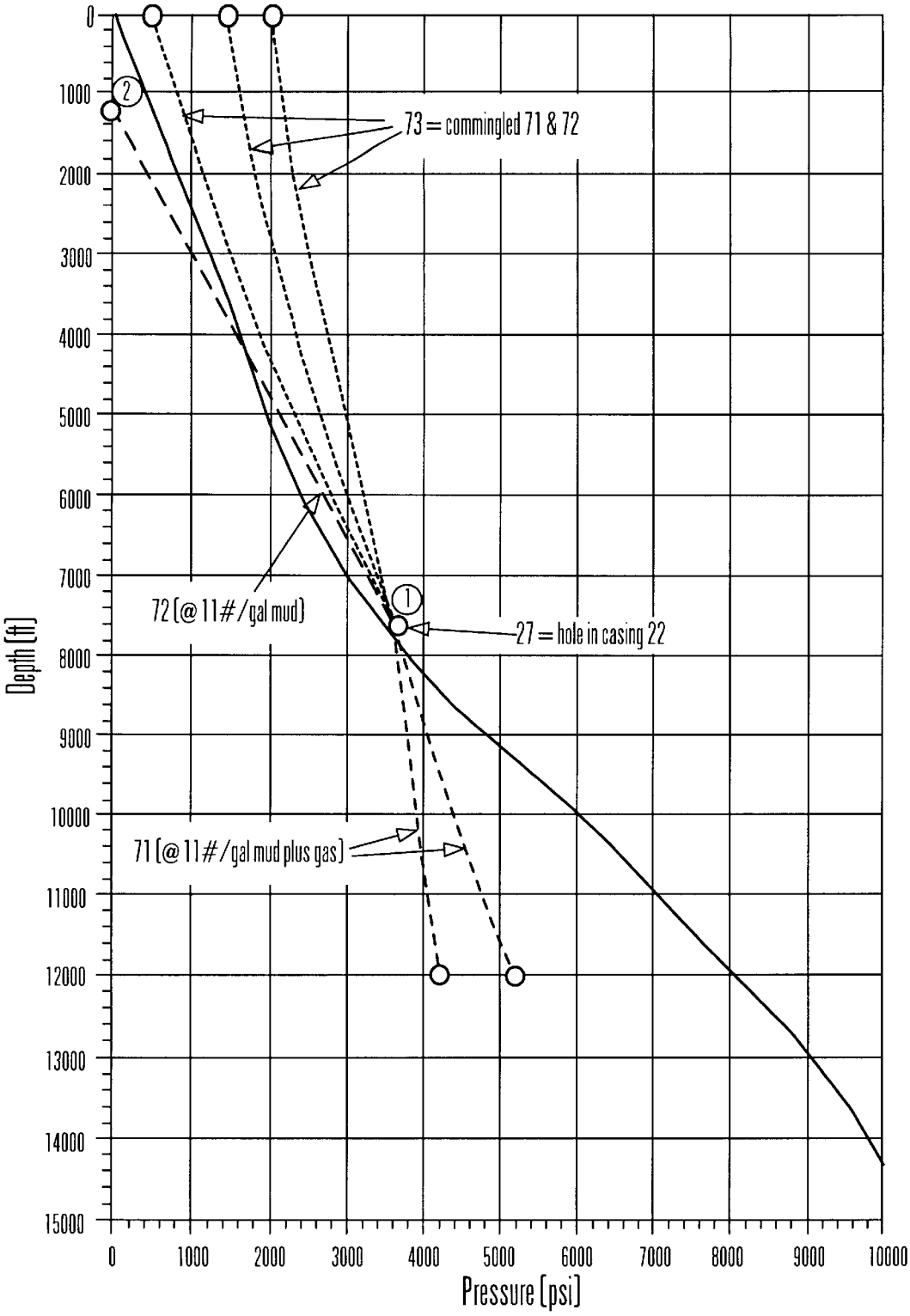
FIG. 10 illustrates the well-bore, pipe tripping pressure profile of Example 2.
Figure 11:
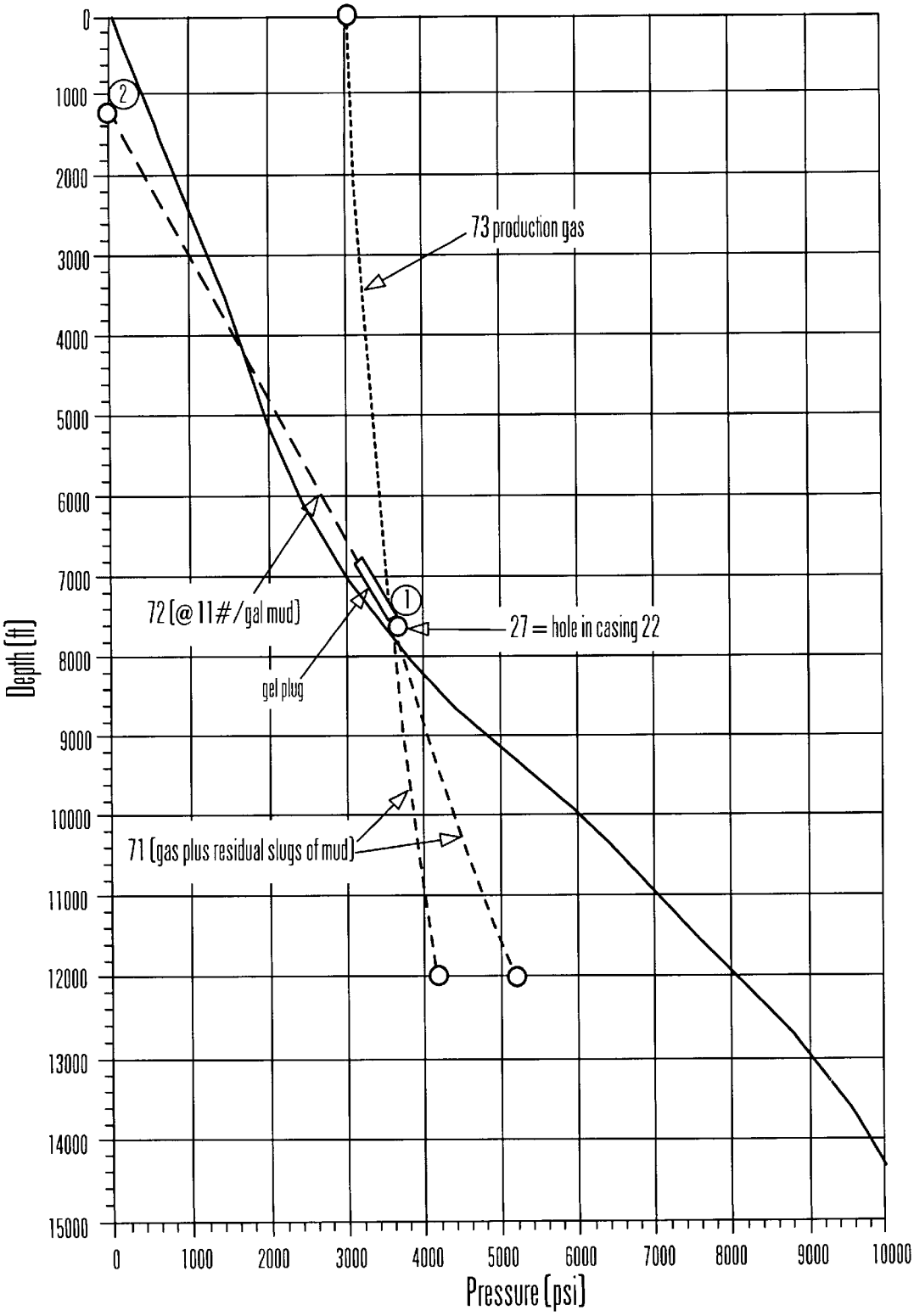
FIG. 11 illustrates the well-bore, pipe tripping methodology of the present invention using a gel-plug barrier.

When the drill pipe is being tripped out of the drill hole for drill bit or equipment change and then back into the hole to resume drilling, the pressure profiles shown in FIG. 9 are changed to approximately the pressure profiles shown in FIG. 10. The major difference between the pressure profile in FIG. 10 compared with FIG. 9 is the pressure profile 71 in the open-drill-hole section below the bottom 27 of the casing 22. In FIG. 10, the lower pressure curve 71 represents the pressure profile resulting from a high rate of gas production (i.e., probably several mmcf/d) blowing essentially all of the drilling mud out of the open hole below the inner casing 22. Also, in FIG. 10, the higher pressure curve 71 represents the pressure profile resulting from a low rate of gas production (i.e., probably less than 1 mmcf/d) bubbling up through a portion of the drilling mud not blown out of this open-hole section.

The operator can control the rate of injection of the H-control drilling mud 72 flowing down the inside of casing 22 and the surface pressure of the commingled fluids discharged from annulus 73 between the inner 22 and out 21 casings to maintain approximately the same gas production rate during the drill pipe trip illustrated in FIG. 10 as existed during the drilling operation illustrated in FIG. 9. At no time is this gas production killed. The gas production continues at approximately the same rate or slightly higher rate during the drill pipe trip illustrated in FIG. 10 as during the drilling operation illustrated in FIG. 9. After the drill pipe trip is completed with the drill bit back on bottom, drilling mud circulation down drill pipe 51 is slowly resumed until the prior observed drilling pressure profile of FIG. 9 is reestablished. Then the drilling operation can be resumed approximately as previously performed prior to making the drill pipe trip.

It would be very desirable, either continuously or intermittently, to monitor the pressure both at the commingling holes 27 at the bottom of the inner casing 22 and near the bottom of the drill string 51 near the drill bit 53. This pressure monitoring objective may be achieved by using either the currently available pressure pulse MWD transmission system or the electromagnetic MWD transmission systems. Alternatively, an electric wire line can be attached to the outside of the inner casing 22 to provide monitoring of the pressure gauge at the commingling holes 22 at the bottom of casing 22. Also, the available echo-meter technology may be used to intermittently measure the depth from surface down to the top of the drilling mud in the annulus 72 between the drill pipe 51 and the inner casing 22.

When starting to drill slim hole below the inner casing 22 at about 7,500-foot depth, the drilling mud may have a light weight of about 8.5 to 9.0#/gallon. In this initial slim hole drilling, this 8.5 to 9.0#/gallon mud may provide an approximately balanced drilling program where the pressure of the column of mud approximately equals the formation pore-pressure of the gas in the Lance reservoir sands. However, as this drilling proceeds downward through the Lance formation, the pore-pressure of the gas increases more rapidly than the mud pressure, resulting in an under balanced drilling operation where the formation gas is produced into the annulus drilling mud. The resulting gas cut drilling mud has a reduced density, resulting in increased underbalance of the annulus drilling mud compared to the formation pressure.

To prevent excessive underbalance drilling operations, resulting in excessive draw down of the producing reservoir gas pressure, an increased volume of drilling mud is injected down annulus 72 to be commingled through the holes 27 in the casing 22 with the drilling mud and produced formation gas flowing up through the open-hole drilling annulus 71. Then the resulting commingled streams 71 and 72 will flow upward through the H-BOP annulus 73 between the 5 inch inner casing 22 and the 7" outer casing 21, where high pressure stationary seals between the casing head and these two stationary casing strings permit the discharge of those commingled fluids out through appropriate surface manifolds, valves, and pressure control equipment.

As needed for optimum under balanced drilling, the weight of the drilling mud flowing downward through both the drill pipe 51 and the drill pipe annulus 72 may be gradually increased to any weight needed to maintain a zero annulus 72 mud injection pressure and a suitable level of the drilling mud in the drill pipe annulus 72 while maintaining the desired near constant pressure values at the commingling zone 27 at the bottom of the inner H-BOP casing 22. FIG.

9 is drawn to illustrate these control pressure values using an assumed 11 lbs./gallon drilling mud at a drilling depth of about 11,000 to 12,000 feet.

During the drill-pipe tripping operation, the desired constant pressure (2) at the holes 27 in casing 22 and thereby the produced gas pressure profiles 71 can be maintained by either (a) inject sufficient-volume and density of drilling mud down 72 inside casing 22 to provide the pressure profiles shown in FIG. 10 or (b) close a casing shut-off valve at the bottom of casing 22 or create a high gel strength high viscosity pressure balanced gel plug near the bottom of casing 22 to prevent gas from migrating up the column 72 inside casing 22. By this mean all formation fluid production will be diverted out the holes 27 into the H-BOP annulus 73 to create the pressure profile shown in FIG. 11. The use of the pressure balanced gel plug in column 72 near the base of the inner casing 22 provides a unique and valuable part of this invention. This gel plug is created and positioned by pumping a volume of pre-gelled fluid down the drill pipe 51 equal to about 500 feet of displacement volume inside the 5" inner casing 22, plus a volume of non-gelled fluid down drill pipe 51 equal to about 100 feet of displacement volume of the 5" casing 22 while the drill bit is positioned about 600 feet above the commingling holes 27 near the bottom of casing 22. This will position the gel plug to extend from about 100 feet below the drill bit down 500 feet to the top of the holes 27 near the base of casing 22. This properly positioned pre-gelled plug is then held in this position until the gel fluid is fully gelled and/or cross-linked.

If the pressure (1) at the holes 27 in casing 22 increases, then the gel plug is pushed up hole raising the level (2) of the top of the drilling mud column. Then the surface discharge pressure from annulus 73 can be reduced by surface controls until the top of drilling mud column (2) inside casing 22 returns to its original depth and the pressure (1) at the holes 27 in casing 22 returns to its original value. If the pressure (1) at holes 27 in casing 22 decreases, then this gel plug will move-downward and the bottom portion of it will be eroded or extruded through the holes 27 in casing 22 and thereby destroyed.

Consequently, it is very important to monitor either or both the pressure (1) at the holes 27 in casing 22 or the depth to the top of the drilling mud (2) inside casing 22 to properly control the location of this gel plug. This properly positioned gel plug and the column of drilling mud above this gel plug provides the means to pull the drill pipe out of the hole with zero pressure on the drilling annulus and still have continuous gas production from the open-hole Lance formation producing up through the H-BOP annulus 73 between the inner casing 22 and the outer casing 21 and be discharged from this H-BOP annulus at the surface through surface pressure control equipment.

While running in hole with the drill pipe after tripping, this 500 feet of gel plug can be either drilled up with the drill bit and circulated out through annulus 72 or can be eroded and extruded through the holes 27 and th en circulated out through the H-BOP annulus 73 to the surface. As the drill pipe is slowly lowered through the Lance open-hole section, drilling mud is circulated through the drill bit to slowly restore in increments, the drilling pressure profile illustrated in FIG. 9. Care must be taken to not allow the drilling mud pressure to exceed production drawn-down pressures of those previously drilled and produced reservoirs. When the prior drilling pressure profiles are restored, then drilling can b e resumed.

During the well completion operations, the same pressure profile control must be maintained as described above for the drilling operations. After the drilling and well completion operations are finished, then a bridge plug may be set below the base of the inner casing 22 and this H-BOP inner casing 22 can be pulled out of the well and reused for this same purpose in a subsequent well.

Figure 8B:
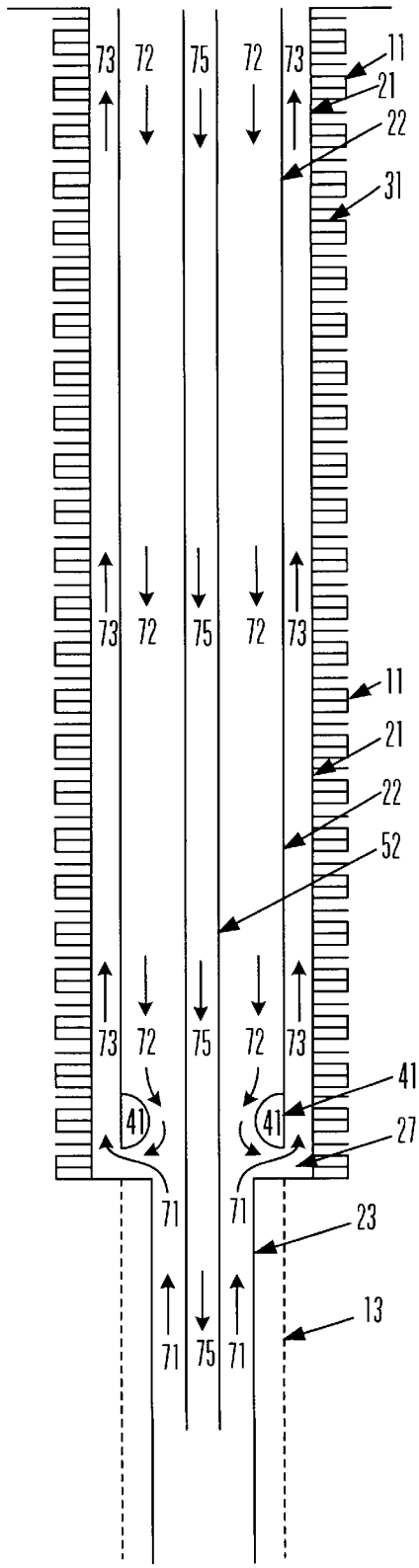

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. Whereas, the example #1 illustrates the application of the present invention to using a conventional drilling rig with jointed drill pipe for drilling the well bore, as configured in FIG. 2, an alternative, slim-hole version of this well bore could be drilled using a continuous coiled tubing drilling assembly, such as described in Example #2. Conversely, the well bore, as configured in FIG. 8, and as described in Example #2 as a coiled tubing drilled slim hole, alternatively could be drilled with a conventional drilling rig and jointed drill pipe. This present invention is applicable to drilling either normal sized drill holes or reduced sized slim holes with either jointed drill pipe on conventional drilling rigs or with continuous coiled tubing on slim-hole drilling assemblies. Engineers skilled in the art of hydraulic fluid flow designs can readily adjust the desired volumetric flow rates used in each of the fluid flow paths (i.e., paths 71, 72, 73, and 75 in FIGS. 1, 2, and 8) to achieve the flow velocities and pressure gradients needed to achieve the objectives of this invention as described herein. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method for under balanced drilling and/or completing of a well, comprising:

introducing a hydrodynamic control fluid into an inner hydrodynamic control casing such that the hydrodynamic control fluid flows downwardly through the inner hydrodynamic control casing to a down-hole location where the hydrodynamic control fluid commingles with a well-bore fluid flowing upwardly from a lower portion of the well bore; and removing the resulting commingled fluids from the well through an outer annulus located between the inner hydrodynamic control casing and an outer casing having a diameter larger than a diameter of the inner hydrodynamic control casing.

2. A method, as claimed in claim 1, wherein the inner hydrodynamic control casing and outer casing are each stationary, at least most of the upward flowing lower well-bore fluids are prevented from reaching the surface inside the inner hydrodynamic control casing, and the hydrodynamic control fluid is selected to have a high enough density to provide a relatively low well-head injection pressure of the hydrodynamic control fluid in the inner hydrodynamic control casing.

3. A method, as claimed in claim 1, wherein the well-bore surface discharge pressure of the commingled fluids flowing up to the surface through the outer annulus is controlled through at least one of discharge manifolds, valves, and other equipment to provide a relatively low well-head injection pressure of the hydrodynamic control fluid.

4. A method, as claimed in claim 1, wherein an injection rate and a viscosity of the hydrodynamic control fluid are selected to inhibit oil and/or gas bubbles or slugs from migrating by buoyancy forces upwardly through the downwardly flowing hydrodynamic control fluid inside said inner hydrodynamic control casing.

5. A method, as claimed in claim 1, wherein a hydrodynamic partial-flow barrier, with a decreased cross-sectional flow area, is provided at or near a bottom end of the inner hydrodynamic control casing and above the position where the downwardly flowing hydrodynamic control fluid commingles with the upwardly flowing well-bore fluid, thereby diverting the commingled fluids into the outer annulus between the inner hydrodynamic control casing and the outer casing.

6. A method, as claimed in claim 1, wherein a gel strength of the hydrodynamic control fluid injected down the inner hydrodynamic control casing is increased to decrease the rate of upward buoyancy migration of oil and/or gas bubbles or slugs in the hydrodynamic control fluid, thereby decreasing the required volume rate of injecting the hydrodynamic control fluid to divert out into the outer annulus at least substantially all of the well-bore fluid flowing upwardly from the lower portion of the well-bore.

7. A method, as claimed in claim 1, wherein a gel plug of high gel strength is positioned inside the inner hydrodynamic control casing above the location where the well-bore fluid flowing upwardly from the lower portion of the well bore is diverted out into the outer annulus and the position of the gel plug is maintained by holding a level of the top of the hydrodynamic control fluid above the gel plug to the height required for the bottom of the gel plug to have the same pressure as the pressure of the well-bore fluid located just below the gel plug.

8. A method, as claimed in claim 7, wherein the gel plug is created by displacing down the inside of the inner hydrodynamic control casing a pre-gelled solution until the bottom of the pre-gelled solution reaches the location where the well-bore fluid flowing upward from the lower portion of the well bore is diverted out into the outer annulus between the inner hydrodynamic control casing and the outer casing, at which time the pre-gelled solution displacement is stopped and the gelling process proceeds to form the gel plug to direct the well-bore fluid into the outer annulus.

9. A system for under balanced drilling and/or completing of a well, comprising:

a well bore;

at least two casings positioned in the wellbore to define:

an outer flow path between the at least two casings extending upwardly along a portion of the well bore;

an inner flow path inside an intermediate casing extending upwardly along a portion of the well bore wherein the outer and inner flow paths are in communication with one another in a lower portion of the well bore; and a lower flow path positioned below each of the outer and inner flow paths and in communication with at least one of the outer and inner flow paths, whereby a hydrodynamic control fluid is injected downwardly into one of the inner and outer flow paths and a commingled fluid including the hydrodynamic control fluid and at least a portion of the well bore fluid moving upwardly in the lower flow path is directed into the other one of the inner and outer flow paths and the flow direction in each flow path is controlled by controlling the hydrodynamic control fluid injection rate, density, viscosity, and gel strength without using any downhole valves to control any of these fluid flow directions.

10. The system of claim 9, wherein the at least two casings includes an outer well-bore casing extending downwardly from the surface to a first depth in the well bore, the intermediate casing positioned inside of the outer well-bore casing and extending downwardly from the surface to a second depth in the well bore, and an inner drill casing positioned inside of the intermediate casing and extending downwardly from the surface to a third depth in the well bore.

11. The system of claim 10, wherein the third depth is greater than each of the first and second depths.

12. The system of claim 11, wherein the first depth is greater than the second depth to provide a passageway through which the outer, inner, and lower flow paths are in communication with one another.

13. The system of claim 10, wherein the outer well-bore casing is permanently attached to the well bore and the intermediate casing and the inner drill casing are removably positioned in the well bore.

14. The system of claim 10, wherein the outer well-bore casing and the intermediate casing are substantially stationary during the under balanced drilling of the well bore.

15. The system of claim 9, wherein the inner flow path includes a device positioned at a lower end of the inner flow path for constricting the flow of the hydrodynamic control fluid past the device by providing a cross-sectional area of flow adjacent to the device that is less than a cross-sectional area of flow in the inner flow path above the device.

16. A method for under balanced drilling and/or completing of a well, comprising:

introducing a hydrodynamic control fluid into a first flow pathway extending along an upper portion of a well bore;

commingling the hydrodynamic control fluid with a well-bore fluid flowing upwardly from a lower portion of the well bore to form a commingled fluid wherein the pressure at the depth at which the commingling step occurs is established at any desired predetermined value;

directing the flow of at least most of the commingled fluid along a second flow pathway that is different from the first flow pathway and extends along an upper portion of the well bore to maintain a fluid pressure in a selected portion of the well bore at or below a predetermined level; and controlling a fluid pressure in the well bore by controlling the hydrodynamic control fluid injection ratio density, viscosity, and gel strength without using any downhole valves to control any of these fluid flow directions or pressures.

17. The method of claim 16, wherein the hydrodynamic control fluid has an injection rate, a specific gravity and a viscosity selected to provide a downward flow velocity sufficient to inhibit the upward migration of oil or gas through the downward flowing hydrodynamic control fluid and to create a low fluid injection pressure.

18. The method of claim 16, further comprising forming a gel plug in a lower portion of the first flow pathway to inhibit the well bore fluid from entering the first flow pathway and further comprising removing a drill string from the well bore after formation of the gel plug.

19. The method of claim 16, further comprising using overbalanced drilling techniques to form the upper portion of the well bore and then deepening the well bore using under balanced drilling techniques.

20. The method of claim 16, wherein the first and second flow pathways intersect and further comprising maintaining the fluid pressure at the intersection substantially constant during under balanced drilling of the well bore and during tripping the drill pipe in and out of the well-bore.

21. The method of claim 16, wherein in the introducing step a pump is used to inject hydrodynamic control fluid into the first flow pathway and the pump is operating at substantially atmospheric pressure or at less than atmospheric pressure.

* * * * *